US010833416B2

(12) United States Patent
Morrison

(10) Patent No.: US 10,833,416 B2
(45) Date of Patent: Nov. 10, 2020

(54) ANTENNA HAVING AN OMNI DIRECTIONAL BEAM PATTERN WITH UNIFORM GAIN OVER A WIDE FREQUENCY BAND

(71) Applicant: CommScope Technologies LLC, Hickory, NC (US)

(72) Inventor: Charles B. Morrison, Forest, VA (US)

(73) Assignee: CommScope Technologies LLC, Hickory, NC (US)

( * ) Notice: Subject to any disclaimer, the term of this patent is extended or adjusted under 35 U.S.C. 154(b) by 231 days.

(21) Appl. No.: 15/498,906

(22) Filed: Apr. 27, 2017

(65) Prior Publication Data

US 2017/0352961 A1 Dec. 7, 2017

Related U.S. Application Data

(60) Provisional application No. 62/346,877, filed on Jun. 7, 2016.

(51) Int. Cl.
*H01Q 9/04* (2006.01)
*H01Q 5/25* (2015.01)
(Continued)

(52) U.S. Cl.
CPC ..... *H01Q 9/0464* (2013.01); *H01Q 5/25* (2015.01); *H01Q 7/00* (2013.01); *H01Q 21/062* (2013.01)

(58) Field of Classification Search
CPC ..... H01Q 9/065; H01Q 5/30; H01Q 1/246; H01Q 1/36; H01Q 21/26; H01Q 21/062; H01Q 19/108; H01Q 21/24; H01Q 9/285
See application file for complete search history.

(56) References Cited

U.S. PATENT DOCUMENTS 4,434,425 A 2/1984 Barbano
4,555,708 A * 11/1985 Waineo ..... H01Q 9/065 343/799

(Continued)

FOREIGN PATENT DOCUMENTS

EP 2950385 12/2015
JP 2004088325 A 3/2004
WO 2014110508 7/2014

OTHER PUBLICATIONS

International Search Authority, "International Search Report and the Written Opinion for PCT/US2017/029807", "Foreign Counterpart to U.S. Appl. No. 15/498,906", dated Aug. 8, 2017, pp. 1-18, Published in: WO.

(Continued)

*Primary Examiner* — Dameon E Levi
*Assistant Examiner* — David E Lotter
(74) *Attorney, Agent, or Firm* — Fogg & Powers LLC

(57) ABSTRACT

In an embodiment, an antenna array includes at least first and second antenna rings. The antennas in the first antenna ring are each spaced apart by approximately a first distance from a center of the first antenna ring. And the second antenna rings is approximately concentric and coplanar with the first antenna ring, and each antenna of the second antenna ring is spaced approximately a second distance from the center. For example, the antennas of the first antenna ring are spaced apart by half of a first wavelength corresponding to a first frequency of a frequency range over which the antenna array is designed to operate, and the antennas of the second antenna ring are spaced apart by half of a second wavelength corresponding to a second frequency of the frequency range.

28 Claims, 17 Drawing Sheets

(51) Int. Cl.
*H01Q 21/06* (2006.01)
*H01Q 7/00* (2006.01)

(56) References Cited

U.S. PATENT DOCUMENTS

| | | | | |
|---|---|---|---|---|
| 5,581,267 | A | 12/1996 | Matsui et al. | |
| 8,068,065 | B1 * | 11/2011 | Struckman | H01Q 11/10 343/792.5 |
| 9,812,790 | B2 * | 11/2017 | Lavedas | H01Q 1/521 |
| 2004/0239568 | A1 * | 12/2004 | Masutani | H01Q 9/0464 343/700 MS |
| 2005/0179604 | A1 | 8/2005 | Liu et al. | |
| 2011/0068992 | A1 * | 3/2011 | Payne | H01Q 1/36 343/797 |
| 2014/0022131 | A1 * | 1/2014 | Azulay | H01Q 21/28 343/727 |
| 2015/0357720 | A1 * | 12/2015 | Chen | H01Q 1/521 343/727 |
| 2017/0117626 | A1 * | 4/2017 | Sajuyigbe | H04W 72/1263 |

OTHER PUBLICATIONS

International Bureau, "International Preliminary Report on Patentability from PCT Application No. PCT/US2017/029807 dated Dec. 20, 2018", from Foreign Counterpart to U.S. Appl. No. 15/498,906, pp. 1-15, Published: WO.

European Patent Office, "Extended European Search Report from EP Application No. 17810677.9 dated Dec. 5, 2019", From Foreign Counterpart of U.S. Appl. No. 15/498,906, pp. 1-8, Published in EP.

* cited by examiner

ANTENNA HAVING AN OMNI DIRECTIONAL BEAM PATTERN WITH UNIFORM GAIN OVER A WIDE FREQUENCY BAND

CROSS-REFERENCE TO RELATED APPLICATIONS

This application claims the benefit of U.S. Provisional Application Ser. No. 62/346,877, filed Jun. 7, 2016, the contents of all of which are hereby incorporated by reference.

BACKGROUND

A wireless-communication system can include one or more ultra-wide-band (UWB) antennas, or antenna arrays, that allow the system to operate over a wide frequency band, or over multiple narrow frequency bands within a wide frequency band. For example, an indoor wireless router or access point that operates according to a multiple-input-multiple-output (MIMO) orthogonal-frequency-division-multiplexing (OFDM) technique can include one or more UWB antenna arrays that are operational over a frequency range of at least 0.7 Gigahertz (GHz)-2.7 GHz. With such a UWB antenna array, the router or access point can communicate wirelessly with clients (e.g., computers, smart phones, and tablets) over several popular frequency bands, including those specified by IEEE 802.11b/g/n, IEEE 802.11ah, WI-FI, WI-MAX, Long Term Evolution (LTE), and Personal Communication Service (PCS).

Figure 1:
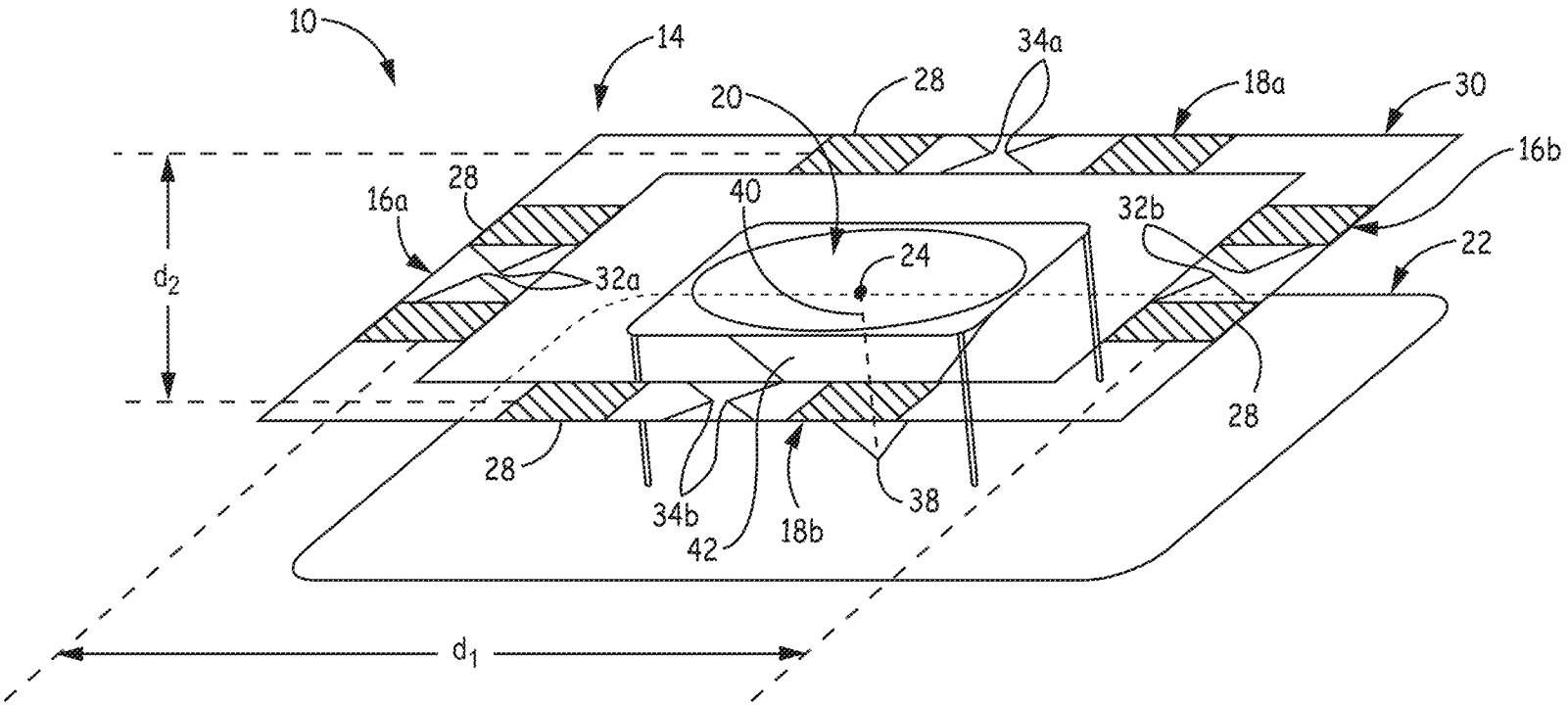
FIG. 1 is an isometric view of a UWB antenna array 10, which is designed for operation over a frequency range of 0.3 GHz-2.7 GHz.

Referring to FIG. 1, the antenna array 10 includes a ring 14 of dipole antennas 16*a*, 16*b*, 18*a*, and 18*b*, a conical monopole antenna 20, and a conductive surface (sometimes called a reference plane or a ground plane) 22. The antenna ring 14 has a square shape and is parallel to the conductive surface 22 (that is, the ring and conductive surface lie in parallel planes), and the monopole antenna 20, which extends between the ring of antennas and the conductive surface 22, is disposed in the center of, and is concentric with, the antenna ring. In a typical application, the antenna array 10 is mounted to a ceiling (or is hidden in a suspended ceiling) with the conductor surface 22 located over the antenna ring 14 and the monopole antenna 20.

The dipole antennas 16 and 18 of the antenna ring 14 are arranged in pairs of opposing antennas. The dipole antennas 16*a* and 16*b* form a first pair of opposing antennas, and are equidistant from a midpoint between them, which midpoint coincides with a center 24 of the ring of antennas; and the dipole antennas 18*a* and 18*b* form a second pair of opposing antennas that are disposed between the antennas 16*a* and 16*b* and that are also equidistant from the center 24. A line (not shown in FIG. 1) that intersects the centers of the antennas 16*a* and 16*b* and the center 24 is perpendicular (i.e., orthogonal) to a line (not shown in FIG. 1) that intersects the centers of the antennas 18*a* and 18*b* and the center 24; therefore, the pair of antennas 16*a* and 16*b* can be said to be orthogonal to, and centered between, the pair of antennas 18*a* and 18*b*. Furthermore, the centers of the antennas 16*a* and 16*b* are spaced apart by a distance of $d_1=\lambda/2$ (i.e., each antenna 16*a* and 16*b* is spaced apart from the center 22 by $d_1/2=\lambda/4$), where h is the wavelength of the lowest frequency (e.g., 0.3 GHz) of the frequency range over which the antenna array 10 is designed to operate. Similarly, the centers of the antennas 18*a* and 18*b* are spaced apart by a distance $d_2=d_1=\lambda/2$ (i.e., each antenna 18*a* and 18*b* is spaced apart from the center 22 by $d_2/2=d_1/2=\lambda/4$). Where the dipole antennas 16*a*, 16*b*, 18*a*, and 18*b* are half-wave ($\lambda/2$) dipoles, then the each antenna spans approximately the entire length of a respective side of the antenna ring 14.

Figure 2:
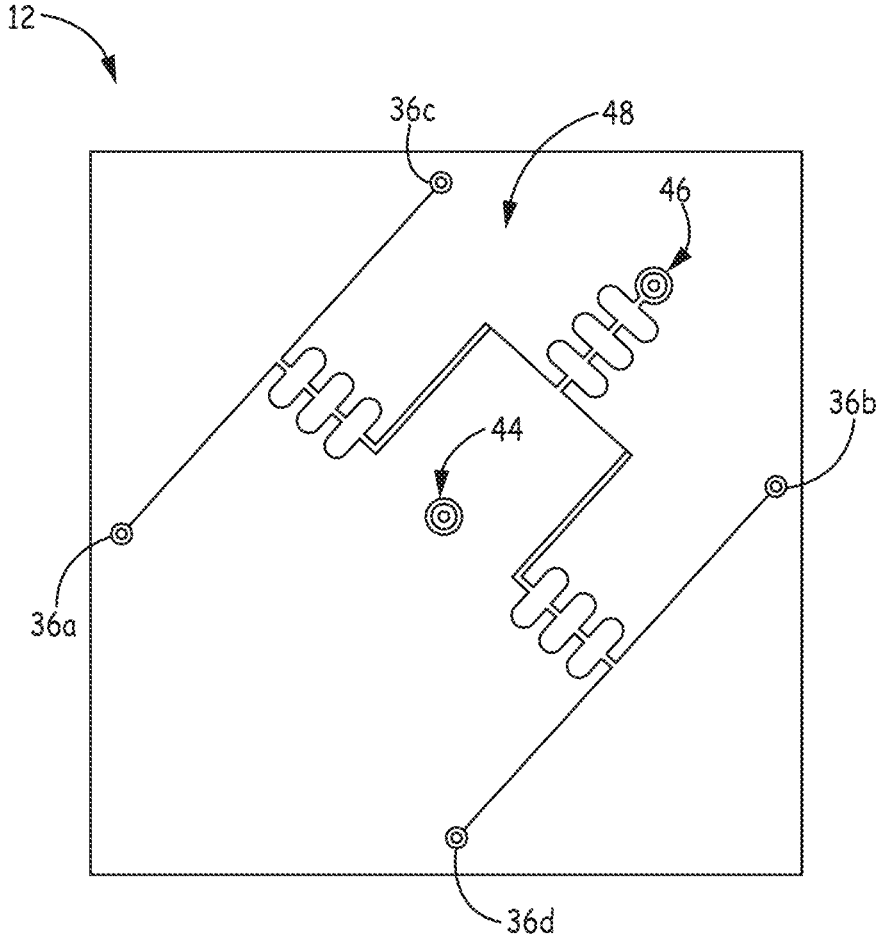
FIG. 2 is a plan view of a feed/receive circuit 12, which is designed for feeding a signal to, and receiving a signal from, the UWB antenna array 10 of FIG. 1.

Referring to FIGS. 1 and 2, the dipole antennas 16*a*, 16*b*, 18*a*, and 18*b* are each formed by a respective conductor 28 disposed on a substrate, such as a printed circuit board (PCB) 30, and are each coupled, at respective drive points 32 and 34, to respective nodes 36 of the feed/receive circuitry 12. For example, the drive points 32*a* of the dipole antenna 16*a* are coupled to the node 36*a* via, for example, a respective balun (not shown in FIGS. 1 and 2). Similarly, the drive points 32*b* of the dipole antenna 16*b* are coupled to the node 36*b* via, for example, a balun (not shown in FIGS. 1 and 2), the drive points 34*a* of the dipole antenna 18*a* are coupled to the node 36*c* via, for example, a respective balun (not shown in FIGS. 1 and 2), and the drive points 34*b* of the dipole antenna 18*b* are coupled to the node 36*d* via, for example, a respective balun (not shown in FIGS. 1 and 2).

Referring to FIG. 1, the conical monopole antenna 20 has an apex 38, and an axis 40 that intersects the apex and the center 24 of the antenna ring 14 such that the axis, and thus the monopole antenna, are orthogonal to the antenna ring 14, and to each of the dipole antennas 16*a*, 16*b*, 18*a*, and 18*b* that collectively form the antenna ring.

Referring to FIGS. 1 and 2, a conical surface 42 of the monopole antenna 20 is formed by a conductor, and the apex 38 is coupled to a node 44 of the feed/receive circuitry 12. The monopole antenna 20 can be driven in an unbalanced manner, e.g., with a coaxial cable (not shown in FIGS. 1 and 2) having its center conductor coupled to the node 44 and having its shield (outer conductor) coupled to the conductive surface 22.

Referring to FIG. 2, the feed/receive circuit 12 is coupled to transmit/receive circuitry (not shown in FIG. 2) at nodes 44 and 46. A portion 48 of the feed/receive circuit 12 that couples the node 46 to the nodes 36*a*-36*d* functions as an impedance-matching splitter/combiner. During a transmit operation, the portion 48 splits the signal received at the node 46 (from the transmit/receive circuitry) into four signals of equal power, and provides these four signals to the nodes 36*a*-36*d*. And during a receive operation, the portion 48 combines the four signals received at the nodes 36*a*-36*d* into a one signal, and provides this combined signal to the node 46.

Referring to FIGS. 1 and 2, during operation, the structure of the UWB antenna array 10, and the manner in which the array is excited, provide a significant level of isolation (e.g., 35 dB or more) between the conical monopole antenna 20 and the dipole antennas 16*a*, 16*b*, 18*a*, and 18*b* of the antenna ring 14.

The structure of the UWB antenna array 10 is such that the polarizations of the electromagnetic waves generated/received by the dipole antennas 16*a*, 16*b*, 18*a*, and 18*b* are orthogonal to the polarization of the electromagnetic waves generated/received by the conical monopole antenna 20. For example, the electric field $\vec{E}$ of the electromagnetic waves generated/received by the dipole antenna 16*a* is in a dimension parallel to the sides of the antenna ring 14 including the dipole antennas 16*a* and 16*b*, but $\vec{E}$ of the electromagnetic waves generated/received by the monopole antenna 20 is in a dimension perpendicular to the antenna ring. Similarly, the electric field $\vec{E}$ of the electromagnetic waves generated/received by the dipole antenna 18*a* is in a dimension parallel to the sides of the antenna ring 14 including the dipole antennas 18*a* and 18*b*, but, as described immediately above, $\vec{E}$ of the electromagnetic waves generated/received by the monopole antenna 20 is in a dimension perpendicular to the antenna ring.

Furthermore, the UWB antenna array 10 is excited such that the polarities of the electromagnetic waves generated/received by the dipole antennas 16*a*, 16*b*, 18*a*, and 18*b* cancel at the center 24 of the antenna ring 14 such that there is zero energy from these waves at the center. For example, during transmission, the dipole antenna 16*a* is driven 180° out of phase relative to the dipole antenna 16*b*; the transmit/receive circuitry (not shown in FIGS. 1 and 2) or the feed circuit 12 can be configured to provide this 180° phase difference, i.e., phase shift. Because the antennas 16*a* and 16*b* are equidistant from the center 24 of the antenna ring 14, the magnitudes of the waves generated/received by the antennas 16*a* and 16*b* are equal at the center, but the polarities of these waves are opposite (e.g., the wave from the antenna 16*a* has a positive "+" polarity and the wave from the antenna 16*b* has a negative "−" polarity). Therefore, the waves generated/received by the antenna 16*a* effectively cancel the waves generated/received by the antenna 16*b* such that energy at the center 24 of the antenna ring 14 due to the antennas 16*a* and 16*b* is zero. And even though the surface 42 of the monopole antenna 20 has portions, other than the apex 38, not at, or not aligned with, the center 24, because the antennas 16*a* and 16*b* are spaced apart by $d_1=\lambda/2$ and the monopole antenna 20 is centered about the center of the antenna ring 14, the amplitude (magnitude and polarity considered together) at one portion of the surface 42 is opposite the amplitude at another portion of the surface 42; therefore, the waves generated/received by the antenna 16*a* still effectively cancel the waves generated/received by the antenna 16*b* at the surface 42 of the monopole antenna 20 such that energy at the monopole antenna due to the antennas 16*a* and 16*b* is zero. And per a similar analysis, the waves generated/received by the antenna 18*a* effectively cancel the waves generated/received by the antenna 18*b* at the surface 42 of the monopole antenna 20 such that energy at the monopole antenna due to the antennas 18*a* and 18*b* is zero.

Further structural and operations details of the UWB antenna 10, and implementations thereof, are described in U.S. Patent Publication No. 2015/0357720, entitled MULTIPLE-INPUT MULTIPLE-OUTPUT ULTRA-WIDEBAND ANTENNAS, filed 13 Jan. 2014, published 10 Dec. 2015, which patent application is incorporated by reference.

Referring again to FIG. 1, and as described in more detail below, at the lowest frequency of the frequency range for which it is designed, the antenna ring 14 of dipole antennas 16*a*, 16*b*, 18*a*, and 18*b* has an omnidirectional beam pattern with a relatively uniform gain.

But as the frequency at which the antenna ring 14 operates is shifted away from the lowest frequency of the designed-for frequency range, the uniformity of antenna ring's gain degrades significantly.

Figure 3:
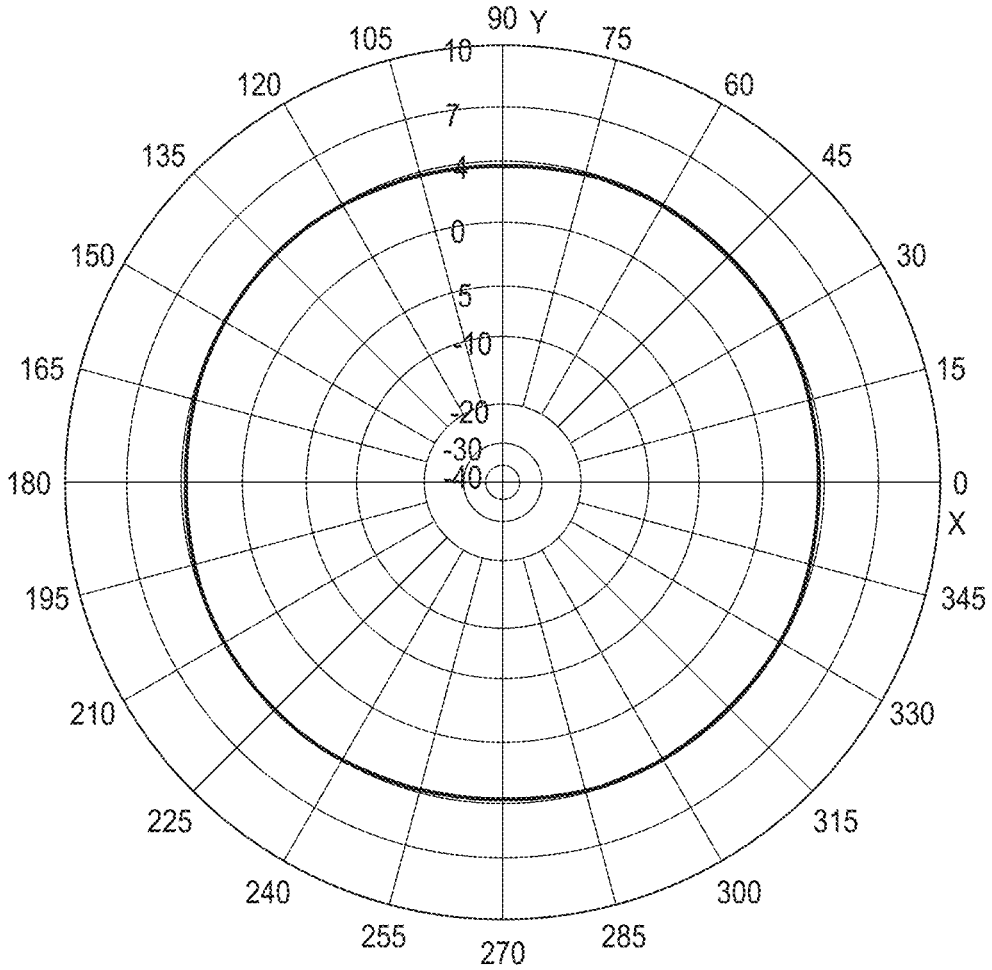

FIG. 3 is a two-dimensional polar plot of the gain of the antenna ring 14 of dipole antennas 16*a*, 16*b*, 18*a*, and 18*b* of FIG. 1 at a frequency of 0.3 GHz, which is the lowest frequency of a frequency range 0.3 GHz-2700 GHz for which the antenna ring is designed.

Figure 4:
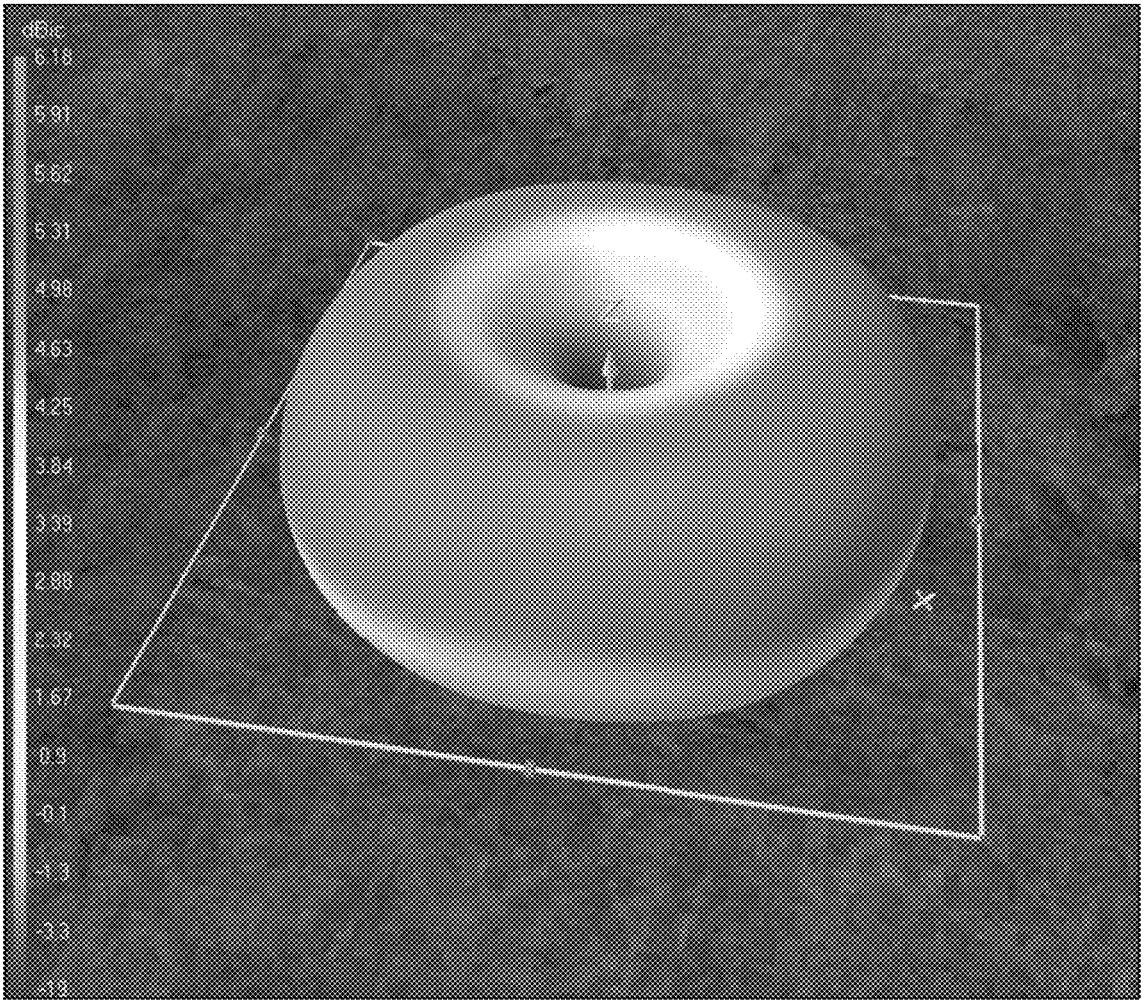

FIG. 4 is a three-dimensional polar plot of the gain of the antenna ring 14 of FIG. 1 at 0.3 GHz.

Figure 5:
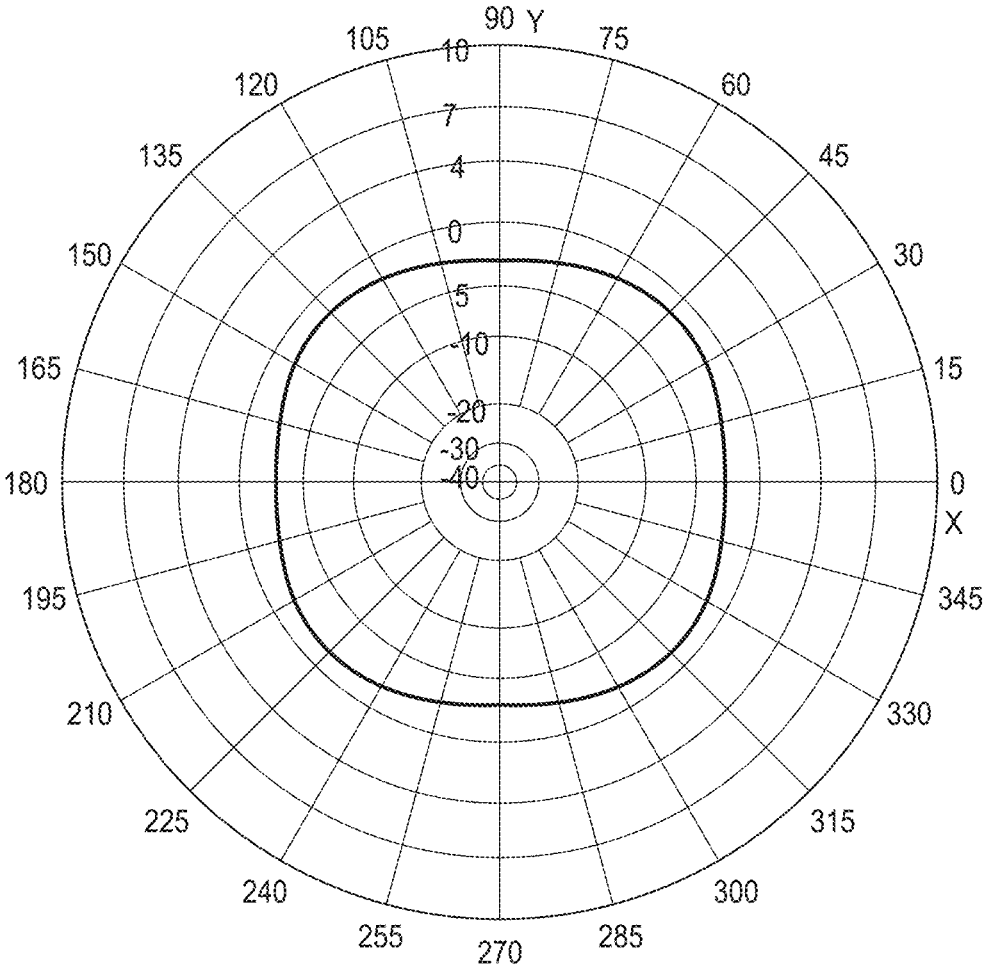

FIG. 5 is a two-dimensional polar plot of the gain of the antenna ring 14 of FIG. 1 at a frequency of 0.6 GHz, which is twice the lowest frequency of the antenna ring's designed-for frequency range.

Figure 6:
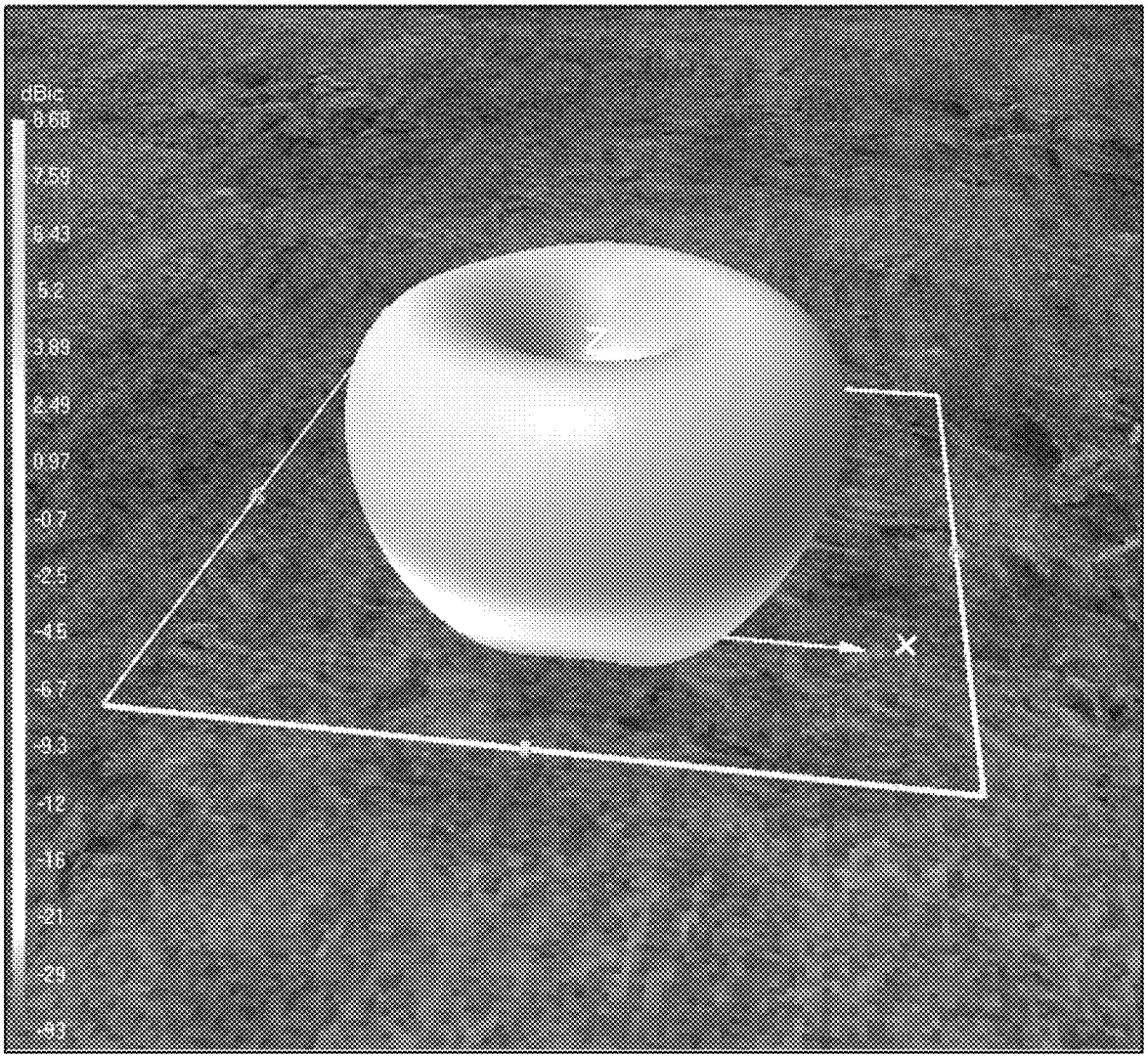

FIG. 6 is a three-dimensional polar plot of the gain of the antenna ring 14 of FIG. 1 at 0.6 GHz.

Figure 7:
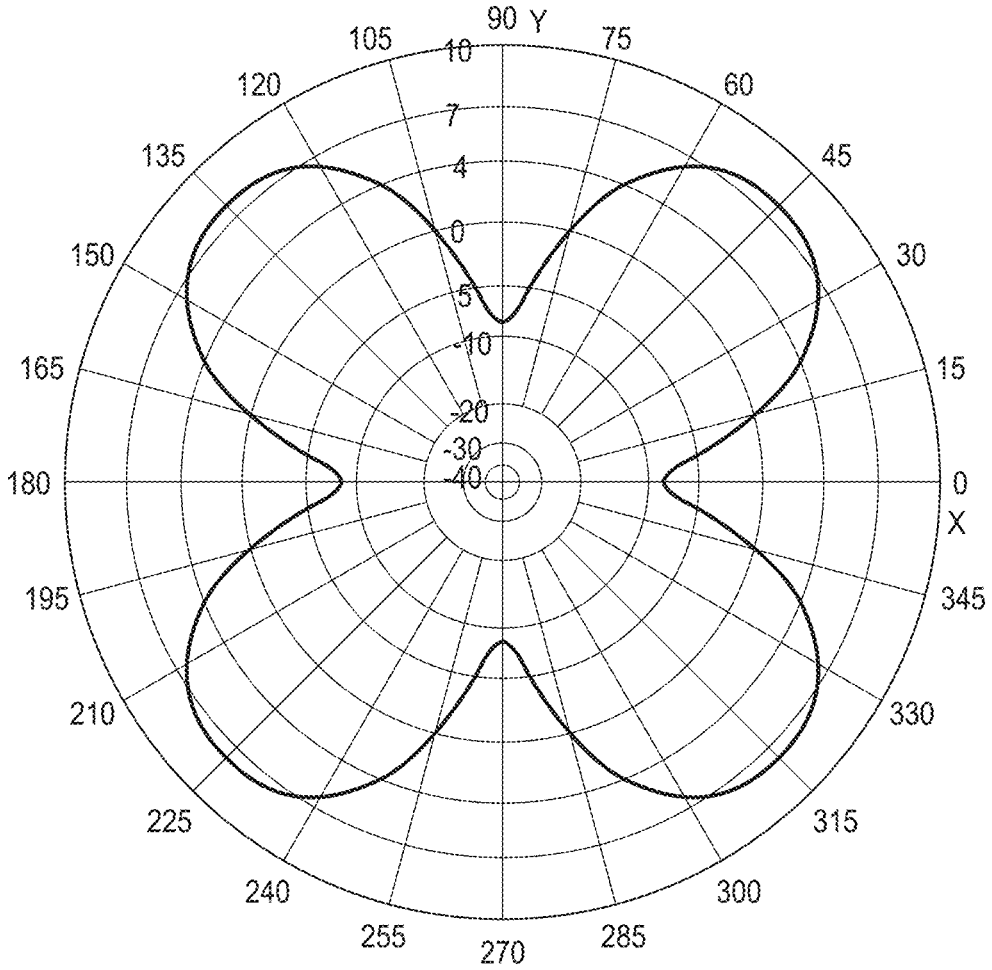

FIG. 7 is a two-dimensional polar plot of the gain of the antenna ring 14 of FIG. 1 at a frequency of 1.2 GHz, which is four times the lowest frequency of the antenna ring's designed-for frequency range.

Figure 8:
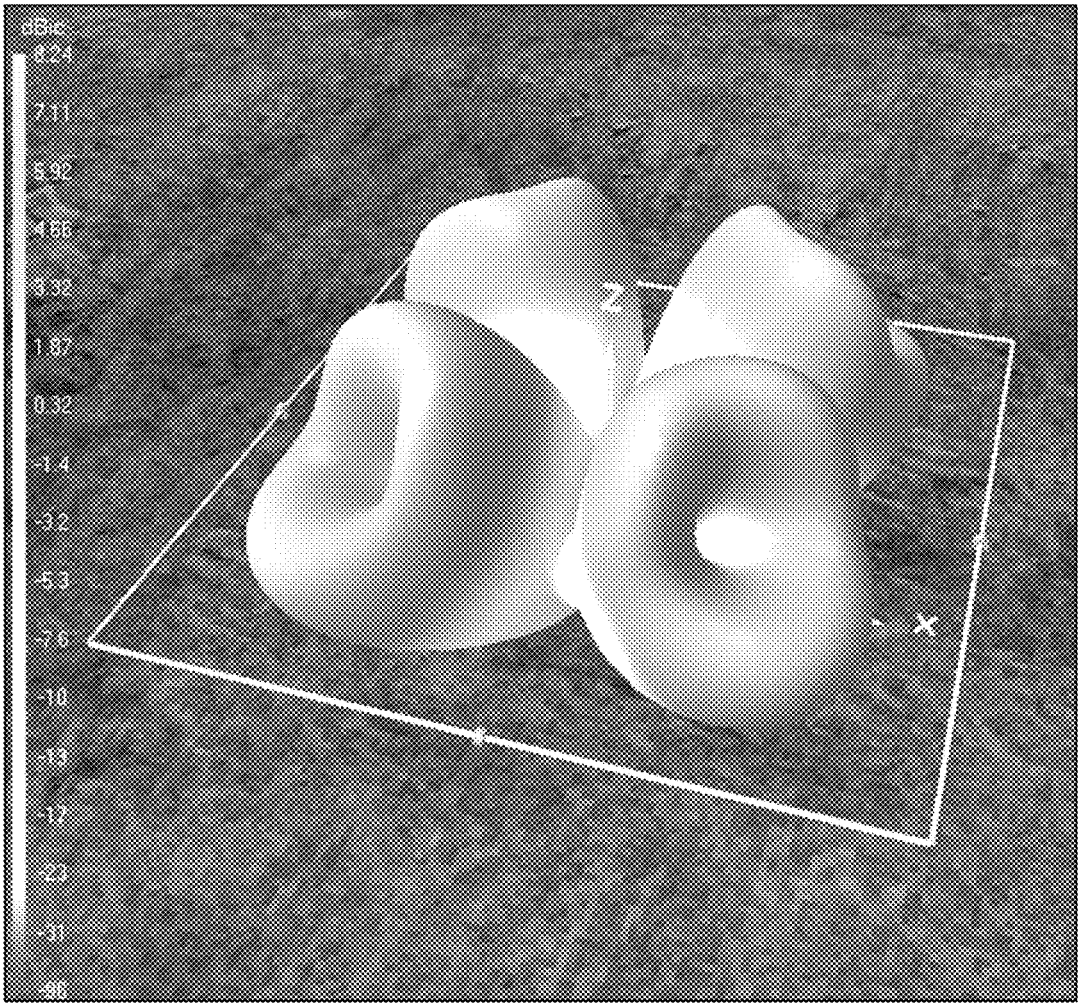

FIG. 8 is a three-dimensional polar plot of the gain of the antenna ring 14 of FIG. 1 at 1.2 GHz.

Referring to FIG. 1, as described above, in an implementation of the antenna array 10, the antenna ring 14 is tuned to operate at a carrier frequency of 0.3 GHz, which is the lowest frequency of a designed-for frequency range of 0.3 GHz-2.7 GHz and which corresponds to a signal having a wavelength $\lambda$=1.0 meters (m). Therefore, the dipole antennas 16*a*, 16*b*, 18*a*, and 18*b* are each spaced from the conductive surface 22 by $\lambda/10$=0.1 m, and are half-wave dipoles that are each $\lambda/2$=0.5 m long.

Referring to FIGS. 1, 3, and 4, when the antenna ring 14 is operated at the frequency 0.3 GHz, the antenna ring's gain is relatively uniform at all azimuth angles, i.e., in all azimuth directions, at each elevation angle—an azimuth plane is parallel to the planes in which the antenna ring and conductive surface 22 respectively lie, and an elevation plane is perpendicular to the azimuth plane. For example, the plot in FIG. 3 shows that the antenna ring 14 has a gain of approximately 4 dBic in all azimuth directions (i.e., 0-360° in an azimuth plane) at an elevation angle of 30° relative to an azimuth plane; for example, where the antenna array 10 is ceiling mounted, this elevation angle can be referred to as "30° below the horizon," where the horizon is a plane in which the conductive surface 22 lies. Furthermore, dBic, in which "ic" stands for "isotropic circular," is the relative gain of the antenna ring 14 compared to the gain at the same elevation angle for a circularly polarized isotropic antenna. Moreover, the plot of FIG. 4 shows that although the gains at elevation angles other than 30° may be different from the 4 dBic gain at an elevation angle of 30°, the gains at these other elevation angles are relatively uniform in all azimuth directions.

But referring to FIGS. 1, 5, and 6, while the antenna ring 14 is operated at 0.6 GHz, which is twice the frequency (and, therefore, half the wavelength) for which it is tuned, the uniformity of the antenna ring's gain is significantly worse than the uniformity of the gains of FIGS. 3 and 4 for the antenna ring operating at 0.3 GHz, the frequency for which the antenna ring is tuned. For example, the plot in FIG. 5 shows that at an elevation angle of 30°, the antenna ring 14 has gains at azimuth angles of 45°, 135°, 225°, and 315° that are significantly higher than the gains of the antenna ring at 0°, 90°, 180°, and 270°. Moreover, the plot of FIG. 6 shows that this non-uniformity in the gain occurs at other elevation angles.

And referring to FIGS. 1, 7, and 8, while the antenna ring 14 is operated at 1.2 GHz, which is four times the frequency (and, therefore, quarter of the wavelength) for which the antenna ring is tuned, the uniformity of the antenna ring's gain is even worse than the uniformity of the gains of FIGS. 5 and 6 for the antenna ring operating at 0.6 GHz. For example, the plot in FIG. 7 shows that at an elevation angle of 30°, the antenna ring 14 has gains at azimuth angles of 45°, 135°, 225°, and 315° that are approximately 16 dBic higher than the gains of the antenna ring at 0°, 90°, 180°, and 270°. Moreover, the plot of FIG. 8 shows that this non-uniformity in the gain occurs at other elevation angles, and is even worse at elevation angles at and near 45°.

Referring again to FIGS. 1-8, in summary, a problem with the antenna ring 14 is that because the uniformity of its gain degrades significantly as the frequency of operation moves away from the frequency for which the antenna ring is tuned, the frequency range over which the antenna ring has a uniform gain is limited.

SUMMARY

In an embodiment, an antenna array includes at least first and second antenna rings. The antennas in the first antenna ring are each spaced apart by approximately a first distance from a center of the first ring. And the second antenna rings is approximately concentric and coplanar with the first antenna ring, and each antenna of the second antenna ring is spaced approximately a second distance from the center. For example, the antennas of the first antenna ring are spaced apart by half of a first wavelength corresponding to a first frequency of a frequency range over which the antenna array is designed to operate, and the antennas of the second antenna ring are spaced apart by half of a second wavelength corresponding to a second frequency of the frequency range.

In an embodiment, such an antenna array can provide a uniform omnidirectional gain over a wider frequency range than can the antenna array 10 of FIG. 1 and other prior antenna arrays. For example, an UWB antenna array that is designed to operate over a frequency range of 0.3 GHz-2.8 GHz includes four antenna rings each having opposing-antenna pairs with the following respective spacings: 0.125 m (corresponds to 2.4 GHz), 0.25 m (corresponds to 1.2 GHz), 0.5 m (corresponds to 0.6 GHz), and 1.0 m (corresponds to 0.3 GHz). That is, each antenna ring within such an antenna array is tuned to operate at a different frequency so as to increase the frequency range over which the omnidirectional gain of the antenna array is uniform.

DRAWINGS

FIG. 1 is an isometric view of a UWB antenna array 10 with a gain having relatively poor uniformity.

FIG. 2 is a plan view of a feed/receive circuit that is designed for feeding signals to, and receiving signals from, the UWB antenna array of FIG. 1.

FIG. 3 is a two-dimensional polar plot of the gain of the antenna ring of FIG. 1 at a frequency for which the antenna ring is tuned.

FIG. 4 is a three-dimensional polar plot of the gain of the antenna ring of FIG. 1 at the frequency for which the antenna ring is tuned.

FIG. 5 is a two-dimensional polar plot of the gain of the antenna ring of FIG. 1 at twice the frequency for which the antenna ring is tuned.

FIG. 6 is a three-dimensional polar plot of the gain of the antenna ring of FIG. 1 at twice the frequency for which the antenna ring is tuned.

FIG. 7 is a two-dimensional polar plot of the gain of the antenna ring of FIG. 1 at four times the frequency for which the antenna ring is tuned.

FIG. 8 is a three-dimensional polar plot of the gain of the antenna ring of FIG. 1 at four times the frequency for which the antenna ring is tuned.

Figure 9:
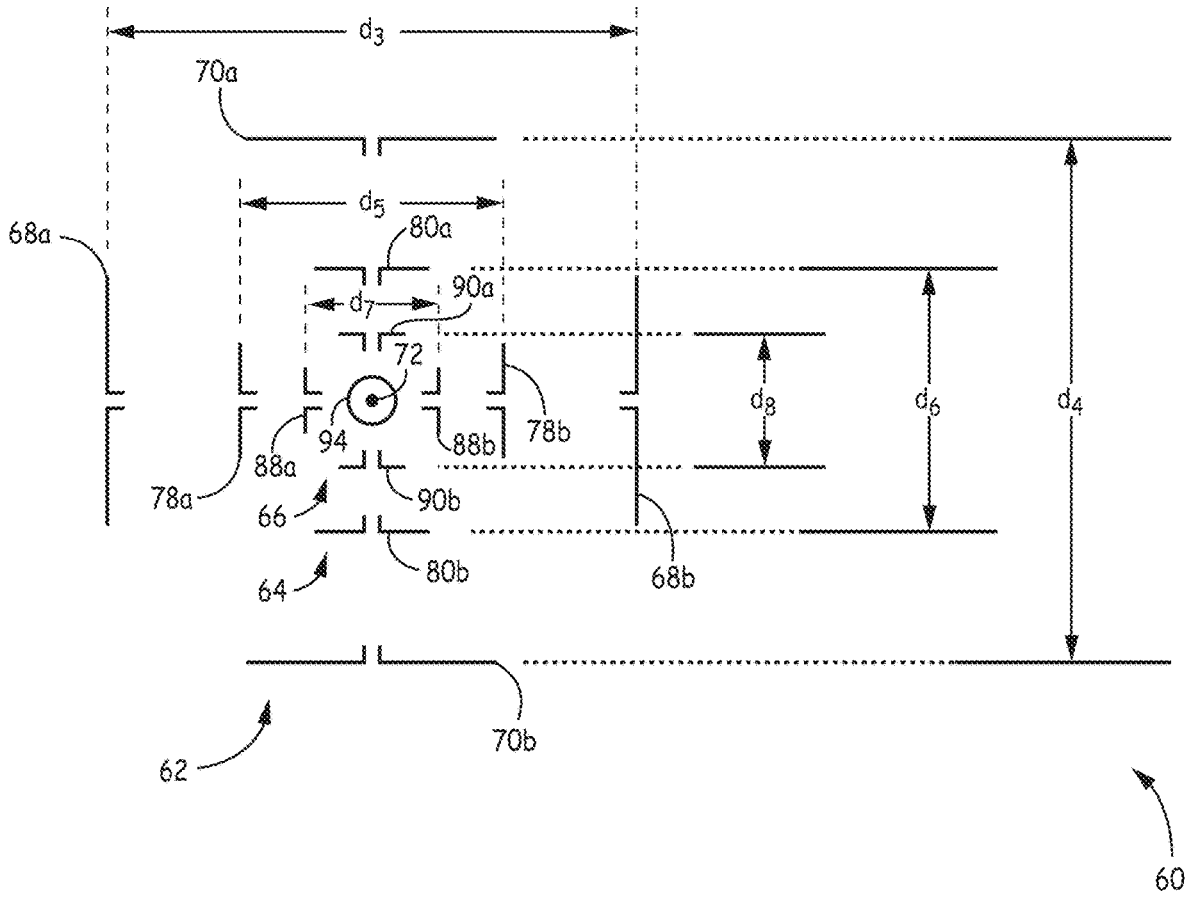

FIG. 9 is a plan view of a UWB antenna array with a gain that is uniform over a wider frequency range than the gain of the antenna array of FIG. 1, according to an embodiment.

Figure 10:
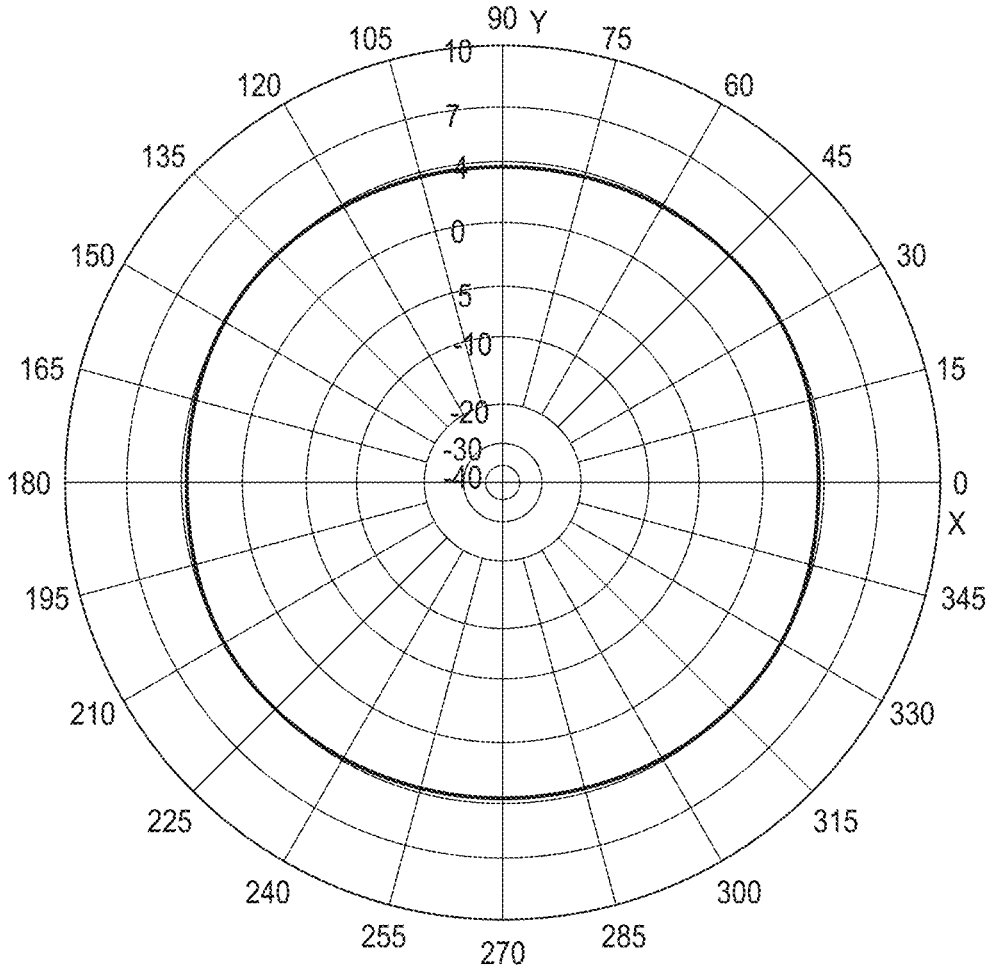

FIG. 10 is a two-dimensional polar plot of the gain of the antenna ring of FIG. 9 at a first frequency, according to an embodiment.

Figure 11:
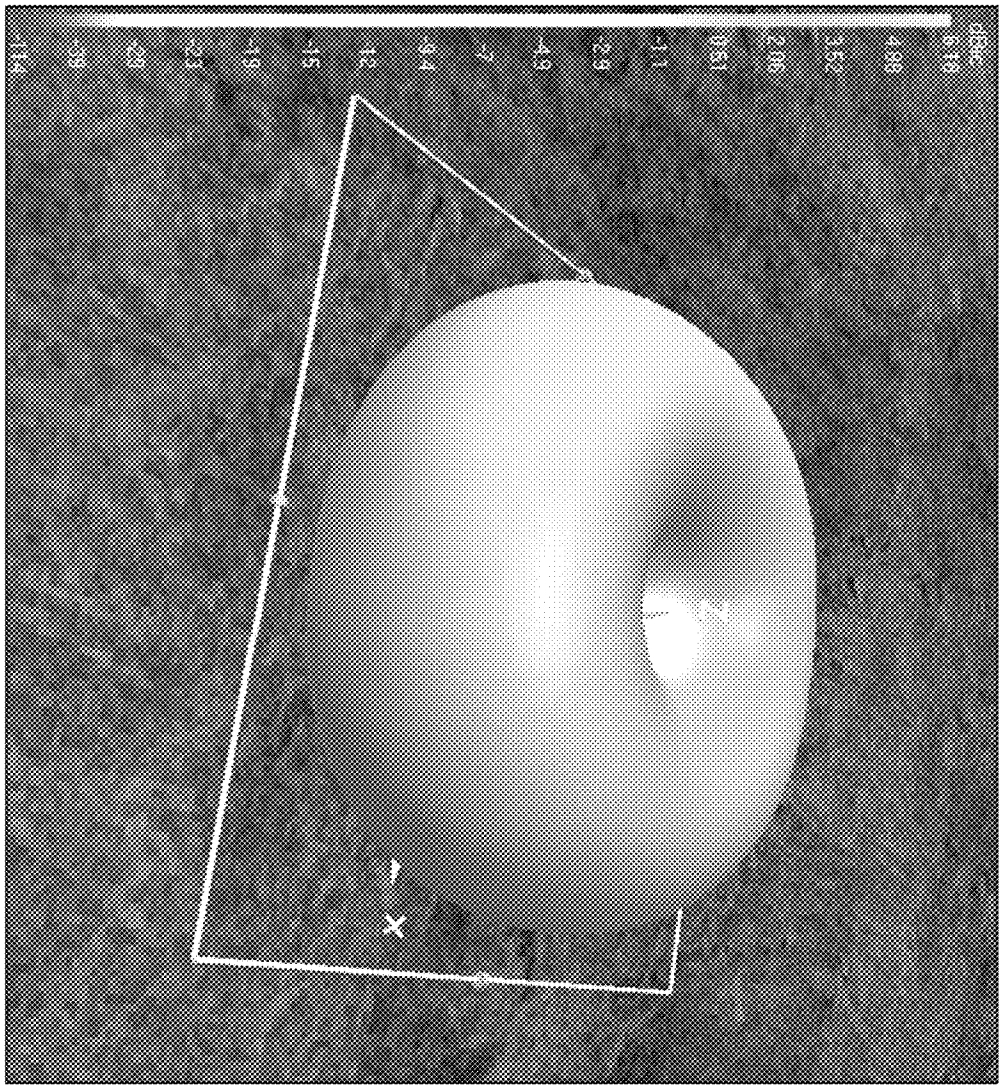

FIG. 11 is a three-dimensional polar plot of the gain of the antenna ring of FIG. 9 at the first frequency, according to an embodiment.

Figure 12:
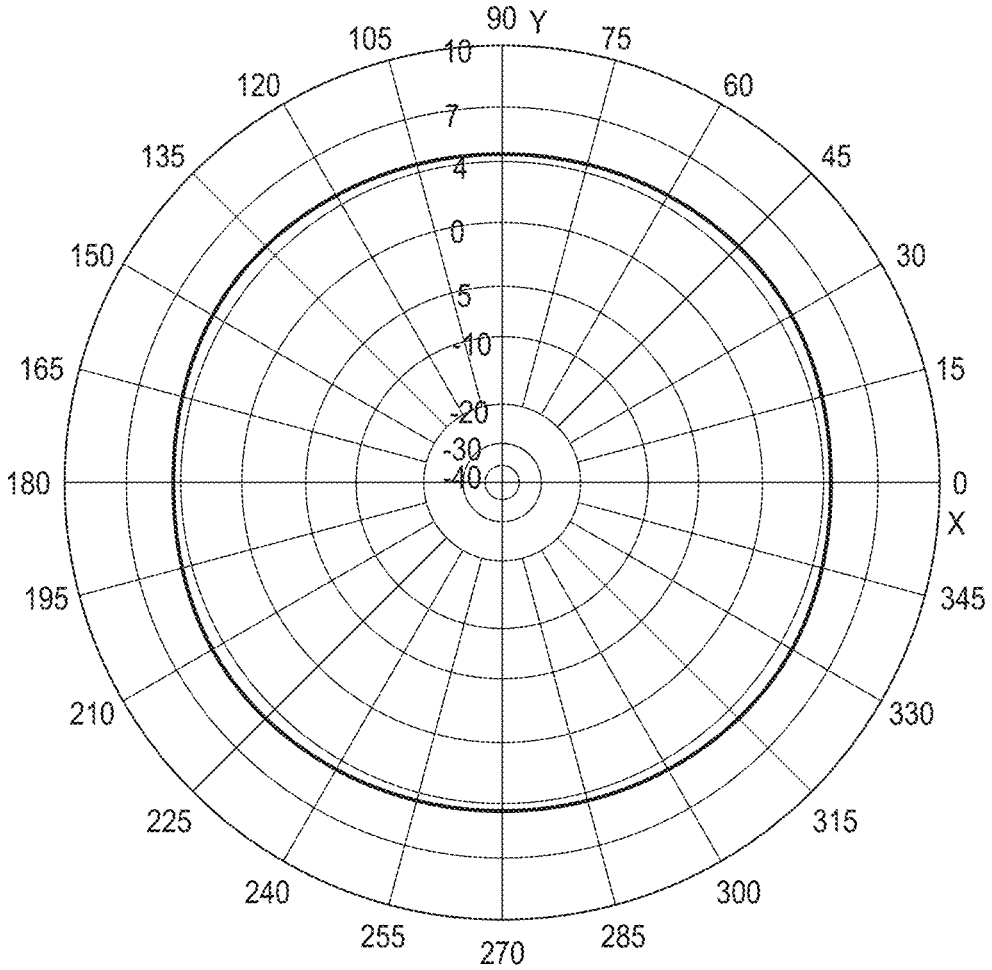

FIG. 12 is a two-dimensional polar plot of the gain of the antenna ring of FIG. 9 at a second frequency that is twice the first frequency, according to an embodiment.

Figure 13:
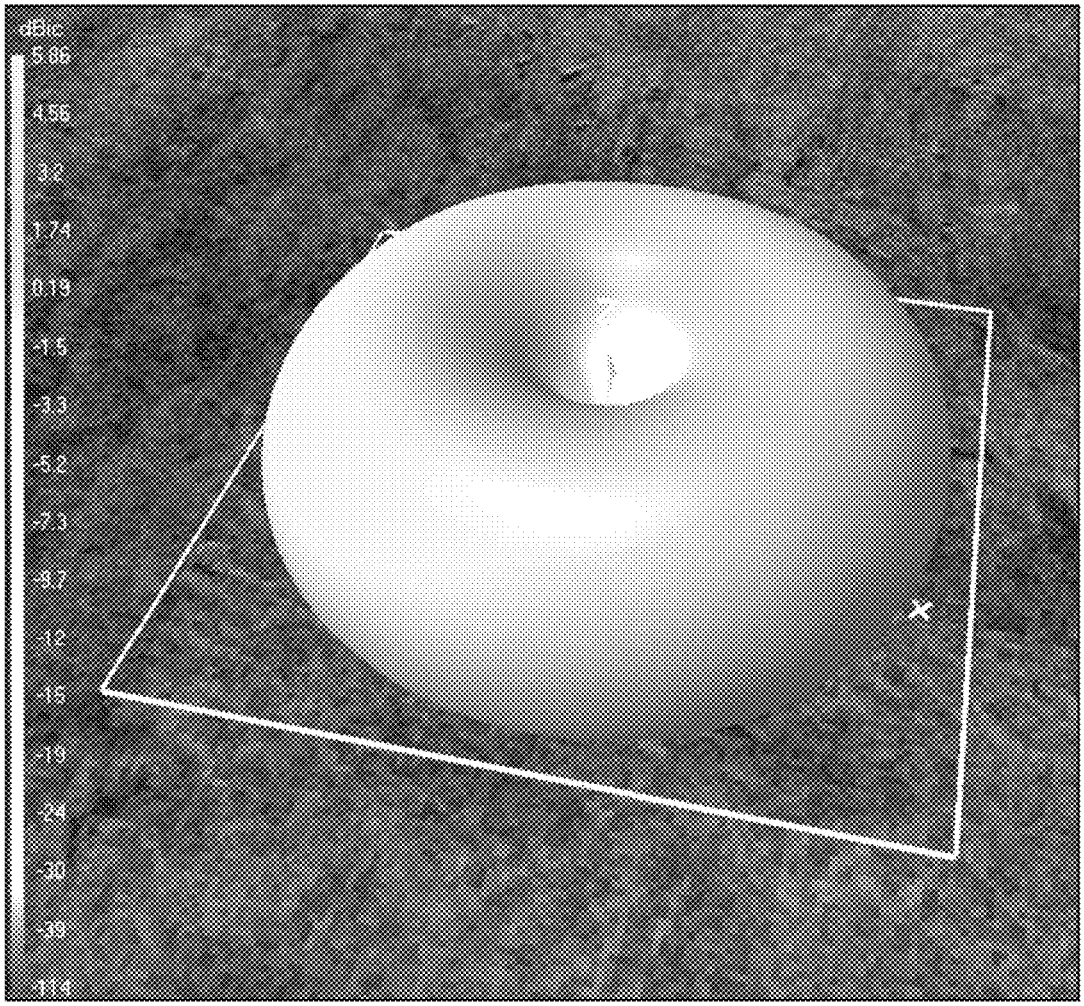

FIG. 13 is a three-dimensional polar plot of the gain of the antenna ring of FIG. 9 at the second frequency, according to an embodiment.

Figure 14:
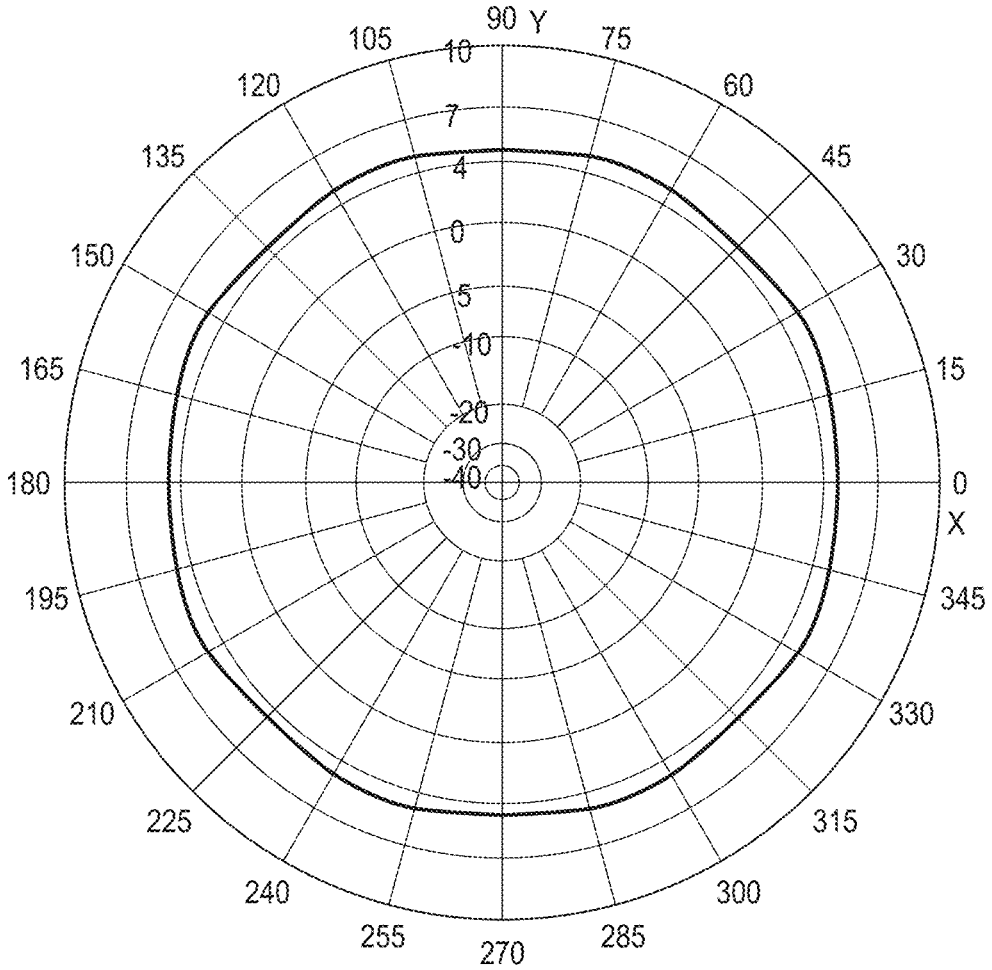

FIG. 14 is a two-dimensional polar plot of the gain of the antenna ring of FIG. 9 at a third frequency that is four times the first frequency and twice the second frequency, according to an embodiment.

Figure 15:
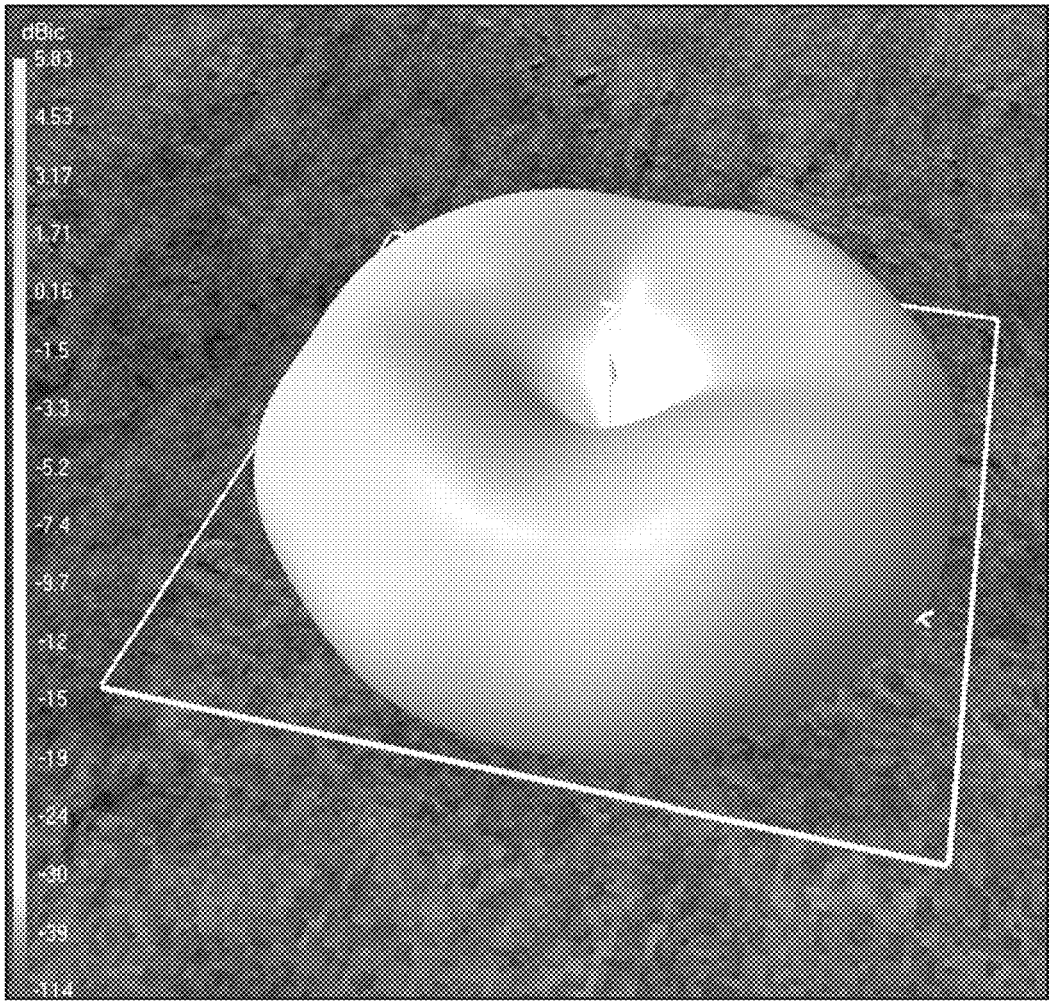

FIG. 15 is a three-dimensional polar plot of the gain of the antenna ring of FIG. 9 at the third frequency, according to an embodiment.

Figure 16:
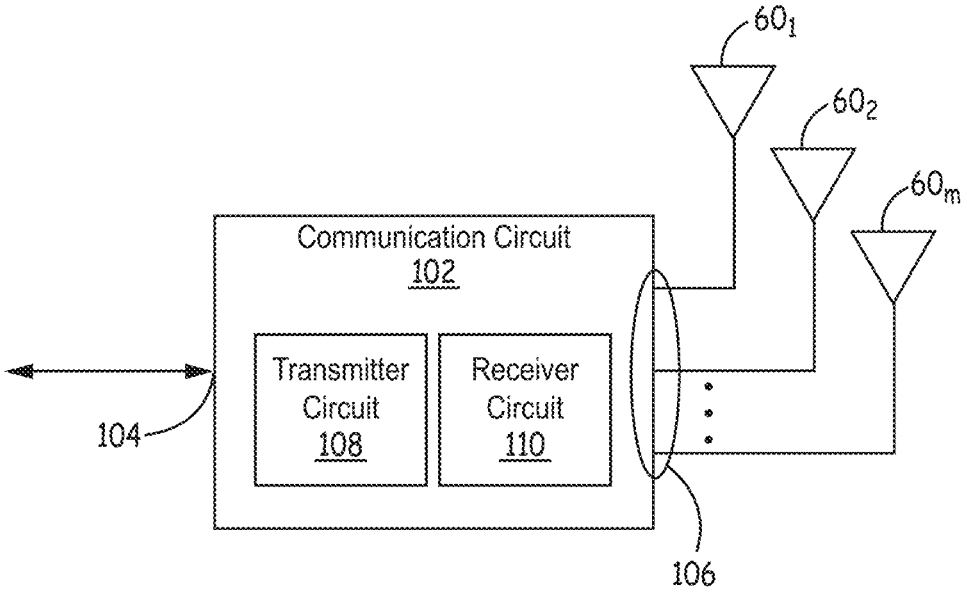

FIG. 16 is a block diagram of a communication unit that includes one or more of the antenna array of FIG. 9, according to an embodiment.

Figure 17:
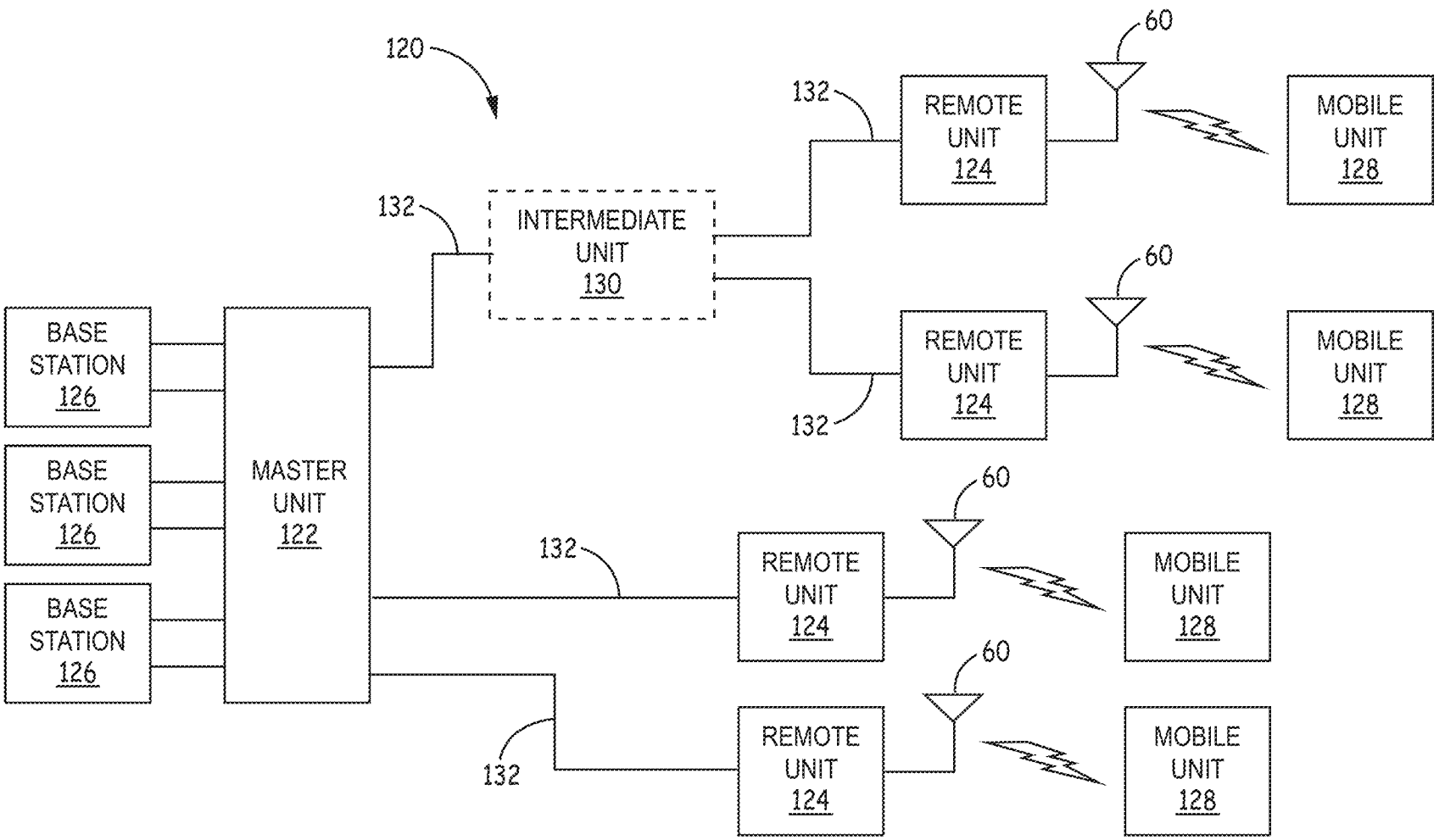

FIG. 17 is a block diagram of a system that includes one or more of the communication units of FIG. 16, according to an embodiment.

DETAILED DESCRIPTION

FIG. 9 is diagram of an UWB antenna array 60, which is designed for operation over a frequency range of 0.3 GHz-2.8 GHz, according to an embodiment. As described below, the gain of the antenna array 60 is uniform over a wider range of frequencies than the gain of the antenna array 10 of FIG. 1. Furthermore, the word "approximately" is used below to indicate that two or more quantities can be exactly equal, or can be within +10% of each other due to manufacturing tolerances, or other design considerations, of the physical structures described below. For example, it is known that to impart to a half-wave dipole particular characteristics (e.g., a purely resistive impedance), the length of the half-wave dipole may not equal $\lambda/2$ exactly.

Referring to FIGS. 1 and 9, the antenna array 60 is similar to the antenna array 10, except that the antenna array 60 includes multiple antenna rings (here three approximately square antenna rings 62, 64, and 66) instead of only a single antenna ring 14. As described below, including multiple antenna rings 62, 64, and 66 in the antenna array 60 causes the collective gain of the antenna rings to be uniform over a wider frequency range as compared to the gain of the single antenna ring 14 of FIG. 1.

The first antenna ring 62, which is the largest antenna ring, is approximately square shaped, includes dipole antennas 68 and 70 arranged in pairs of opposing antennas, and is tuned to operate at a wavelength $\lambda_1$. The dipole antennas 68*a* and 68*b* form a first pair of opposing antennas, and are equidistant from a midpoint between them, which midpoint coincides with a center 72 of the antenna ring 62; and the dipole antennas 70*a* and 70*b* form a second pair of opposing antennas that are disposed between the antennas 68*a* and 68*b* and that are also equidistant from the center 72. A line (not shown in FIG. 9) that intersects the centers of the antennas 68*a* and 68*b* and the center 72 is orthogonal to a line (not shown in FIG. 9) that intersects the centers of the antennas 70*a* and 70*b* and the center 72; therefore, the pair of antennas 68*a* and 68*b* can be said to be orthogonal to, and centered between, the pair of antennas 70*a* and 70*b*, and vice-versa. Furthermore, the centers of the antennas 68*a* and 68*b* are spaced apart by a distance of $d_3=\lambda_1/2$ (i.e., each antenna 68*a* and 68*b* is spaced apart from the center 72 by $d_3/2=\lambda_1/4$), where $\lambda_1$ is the wavelength of the lowest frequency of the frequency range over which the antenna array 60 is designed to operate; for example, if $\lambda_1=1$ m (wavelength at 0.3 GHz), then the antenna ring 62 may be similar in size and structure to the antenna ring 14 of FIG. 1 such that the antenna ring 62 is tuned to operate at 0.3 GHz. Similarly, the centers of the antennas 70*a* and 70*b* are spaced apart by a distance $d_4=d_3=\lambda_1/2$ (i.e., each antenna 70*a* and 70*b* is spaced apart from the center 72 by $d_4/2=d_3/2=\lambda_1/4$). Where the dipole antennas 68*a*, 68*b*, 70*a*, and 70*b* are half-wave ($\lambda_1/2$) dipoles, each antenna spans approximately the entire length of a respective side of the ring 62.

The second antenna ring 64, which is the second largest antenna ring and which is tuned to operate at a wavelength $\lambda_2$, is approximately concentric and approximately coplanar with the first antenna ring 62, includes dipole antennas 78 and 80 arranged in pairs of opposing antennas, where the antennas 78 are approximately parallel to the antennas 68 of the first antenna ring, and where the antennas 80 are approximately parallel to the antennas 70 of the first antenna ring. The dipole antennas 78*a* and 78*b* of the second antenna ring 62 form a first pair of opposing antennas, and are equidistant from a midpoint between them, which midpoint coincides with the center 72 of the first and second antenna rings 62 and 64; and the dipole antennas 80*a* and 80*b* form a second pair of opposing antennas that are disposed between the antennas 78*a* and 78*b* and that are also equidistant from the center 72. A line (not shown in FIG. 9) that intersects the centers of the antennas 78*a* and 78*b* and the center 72 is orthogonal to a line (not shown in FIG. 9) that intersects the centers of the antennas 80*a* and 80*b* and the center 72; therefore, the pair of antennas 78*a* and 78*b* can be said to be orthogonal to, and centered between, the pair of antennas 80*a* and 80*b*, and vice-versa. Furthermore, the centers of the antennas 78*a* and 78*b* are spaced apart by a distance of $d_5=\lambda_2/2$ (i.e., each antenna 78*a* and 78*b* is spaced apart from the center 72 by $d_5/2=\lambda_2/4$), where $\lambda_2$, which is less than $\lambda_1$, is the wavelength at a frequency in the frequency range over which the antenna array 60 is designed to operate; for example, $\lambda_2=\lambda_1/2$. Similarly, the centers of the antennas 80*a* and 80*b* are spaced apart by a distance $d_6=d_5=\lambda_2/2$ (i.e., each antenna 80*a* and 80*b* is spaced apart from the center 72 by $d_6/2=d_5/2=\lambda_2/4$). Where the dipole antennas 78*a*, 78*b*, 80*a*, and 80*b* are half-wave ($\lambda_2/2$) dipoles, then each antenna spans approximately the entire length of a respective side of the second antenna ring 64.

And the third antenna ring 66, which is the smallest antenna ring and which is tuned to operate at a wavelength $\lambda_3$, is approximately concentric and approximately coplanar with the first and second antenna rings 62 and 64, and includes dipole antennas 88 and 90 arranged in pairs of opposing antennas, where the antennas 88 are approximately parallel to the antennas 68 and 78 of the first and second antenna rings, and where the antennas 90 are approximately parallel to the antennas 70 and 80 of the first and second antenna rings. The dipole antennas 88*a* and 88*b* of the third antenna ring 62 form a first pair of opposing antennas, and are equidistant from a midpoint between them, which midpoint coincides with the center 72 of the first, second, third antenna rings 62, 64, and 66; and the dipole antennas 90*a* and 90*b* form a second pair of opposing antennas that are disposed between the antennas 88*a* and 88*b* and that are also equidistant from the center 72. A line (not shown in FIG. 9) that intersects the centers of the antennas 88*a* and 88*b* and the center 72 is orthogonal to a line (not shown in FIG. 9) that intersects the centers of the antennas 90*a* and 90*b* and the center 72; therefore, the pair of antennas 88*a* and 88*b* can be said to be orthogonal to, and centered between, the pair of antennas 90*a* and 90*b*, and vice-versa. Furthermore, the centers of the antennas 88*a* and 88*b* are spaced apart by a distance of $d_7=\lambda_3/2$ (i.e., each antenna 88*a* and 88*b* is spaced apart from the center 72 by $d_7/2=\lambda_3/4$), where $\lambda_3$, which is less than $\lambda_2$ and $\lambda_1$, is the wavelength at a frequency in the frequency range over which the antenna array 60 is designed to operate; for example, $\lambda_3=\lambda_2/2=\lambda_1/4$. Similarly, the centers of the antennas 90*a* and 90*b* are spaced apart by a distance $d_8=d_7=\lambda_3/2$ (i.e., each antenna 90*a* and 90*b* is spaced apart from the center 72 by $d_8/2=d_8/2=\lambda_3/4$). Where the dipole antennas 88*a*, 88*b*, 90*a*, and 90*b* are half-wave ($\lambda_3/2$) dipoles, then each antenna spans approximately the entire length of a respective side of the third antenna ring 66.

Still referring to FIG. 9, the antenna array 60 also includes a conical monopole antenna 94, which can be similar to the conical monopole antenna 20 of FIG. 1, and includes a conductive surface (not shown in FIG. 9), which is approximately parallel to the antenna rings 62, 64, and 66, which spans approximately the area of the antenna ring 62, and which can be otherwise similar to the conductive surface 22 of FIG. 1.

Furthermore, the antenna array 60 can include a feed/receive circuit (not shown in FIG. 9) to drive the dipoles of the first, second, and third antenna rings 62, 64, and 66 during transmission of a signal, and to receive signals from the first, second, and third antenna rings during receiving of a signal. For example, the antenna array 60 can include a respective feed/receive circuit for each antenna ring 62, 64, and 66, where each feed/receive circuit is similar to the feed/receive circuit 12 of FIG. 2. Furthermore, the antenna array 60 can include a feed/receive circuit (not shown in FIG. 9) to drive the monopole antenna 94, which feed/receive circuit can be similar to the feed/receive circuit 12 of FIG. 2.

Moreover, other structural and operational features of the antenna array 60 can be the same as corresponding features of the antenna array 10 of FIG. 1. For example, energy from the dipole antennas of the first, second, and third antenna rings 62, 64, and 66 approximately cancels at the monopole antenna 94 for reasons similar to those described above in conjunction with FIG. 1 as to why energy from the dipole antennas of the antenna ring 14 cancels at the monopole antenna 20. Therefore, there is a significant level of isolation (e.g., 35 dB) between the monopole antenna 94 and the first, second, and third antenna rings 62, 64, and 66.

In addition, applications of the antenna array 60 can include the antenna array being mounted in or to a ceiling in a manner similar to that described above in conjunction with FIG. 1.

Still referring to FIG. 1, and as described in more detail below, the combination of the antenna rings 62, 64, and 66 has an omnidirectional gain that is relatively uniform over a wider range of frequencies as compared to the gain of antenna ring 14 of FIG. 1, according to an embodiment. As described above, each antenna ring 62, 64, and 66 is tuned to operate at a respective wavelength. That is, the antenna ring 62 is tuned such that it has a highest level of gain uniformity at a wavelength $\lambda_1$, the antenna ring 64 is tuned such that it has a highest level of gain uniformity at a wavelength $\lambda_2$, and the antenna ring 66 is tuned such that it has a highest level of gain uniformity at a wavelength $\lambda_3$.

Consequently, by thoughtfully selecting the wavelengths $\lambda_1$, $\lambda_2$, and $\lambda_3$, one can design the antenna rings 62, 64 and 66 so that the combination of these antenna rings has a collective gain that is approximately uniform over a frequency range that is wider than the frequency range over which the gain of the antenna ring 14 of FIG. 1 is approximately uniform.

Referring to FIGS. 9-15, operation of the antenna rings 62, 64, and 66 of the antenna array 60 is described, according to an embodiment. In the described example, the range of operation over which the antenna array 60 is designed to operate is 0.3 GHz-2.8 GHz, $\lambda_1$=1 m (wavelength at 0.3 GHz), $\lambda_2$=0.5 m (wavelength at 0.6 GHz), and $\lambda_3$=0.25 m (wavelength at 1.2 GHz). While the frequency of operation (i.e., the frequency of the transmitted/received carrier wave) corresponds to $\lambda_1$, the transmit/receive circuitry (not shown in FIGS. 9-15) transmits/receives a signal using only the dipoles 68 and 70 of the first antenna ring 62, which dipoles are each approximately $\lambda_1/2$=0.5 m long (the second and third antenna rings 64 and 66 are inactive). Similarly, while the frequency of operation corresponds to $\lambda_2$, the transmit/receive circuitry transmits/receives a signal using only the dipoles 78 and 80 of the second antenna ring 64, which dipoles are each approximately $\lambda_2/2$=0.25 m long (the first and third antenna rings 62 and 66 are inactive). And while the frequency of operation corresponds to $\lambda_3$, the transmit/receive circuitry transmits/receives a signal using only the dipoles 88 and 90 of the third antenna ring 66, which dipoles are each approximately $\lambda_3/2$=0.125 m long (the first and second antenna rings 62 and 64 are inactive). The operation of the antenna array 60 while the frequency of operation corresponds to a wavelength other than $\lambda_1$, $\lambda_2$, or $\lambda_3$ is described further below. Furthermore, the dipole antennas of the antenna rings 62, 64, and 66 are each spaced from the conductive surface (not shown in FIG. 9) by approximately $\lambda_1/10$=0.1 m. Moreover, the feed/receive circuit or the transmit/receive circuitry (neither shown in FIG. 9) causes signals transmitted/received by the dipoles 68*a*, 78*a*, and 88*a* to have approximately a same phase that is shifted by approximately 180° relative to the signals transmitted/received by the dipoles 68*b*, 78*b*, and 88*b*, which signals also have approximately a same phase. Similarly, the feed/receive circuit or the transmit/receive circuitry causes signals transmitted/received by the dipoles 70*a*, 80*a*, and 90*a* to have approximately a same phase that is shifted by approximately 180° relative to the signals transmitted/received by the dipoles 70*b*, 80*b*, and 90*b*, which signals also have approximately a same phase. In addition, the transmit/receive circuitry causes the phases of the signals transmitted by the dipoles 68, 78, and 88 to be shifted by approximately 90° relative to the phases of the signals transmitted by the dipoles 70, 80, and 90 such that the signals transmitted by the antenna rings 62, 64, and 66 are circularly polarized.

FIG. 10 is a two-dimensional polar plot of the collective gain of the antenna rings 62, 64, and 66 of FIG. 9 at an operational frequency of 0.3 GHz, according to an embodiment.

And FIG. 11 is a three-dimensional polar plot of the collective gain of the antenna rings 62, 64, and 66 of FIG. 9 at the operational frequency of 0.3 GHz, according to an embodiment.

Referring to FIGS. 9-11, when the first antenna ring 62 is operated at the frequency of 0.3 GHz (the second and third antenna rings 64 and 66 are inactive), the antenna rings' gain is approximately omnidirectional in the azimuth dimension and is approximately uniform at all azimuth angles, i.e., in all azimuth directions, at each elevation angle. For example, the plot in FIG. 10 shows that the antenna rings 62, 64, and 66 collectively have a gain of approximately 4 dBic in all azimuth directions at an elevation angle of 30° relative to an azimuth plane; for example, where the antenna array 10 is ceiling mounted, this elevation angle can be referred to as "30° below the horizon," where the horizon is a plane in which the conductive surface (not shown in FIGS. 9-11) lies. Moreover, the plot of FIG. 11 shows that although the gains at elevation angles other than 30° may be different from the 4 dBic gain at an elevation angle of 30°, the gains at these other elevation angles are relatively uniform in all azimuth directions. Therefore, because the dipoles 68 and 70 of the antenna ring 62 have the same dimensions as the dipoles 16 and 18 of the antenna ring 14 of FIG. 1, at 0.3 GHz, as one might expect, the antenna rings 62, 64, and 66 have a collective gain similar to the gain of the antenna ring 14 of FIG. 1

FIG. 12 is a two-dimensional polar plot of the collective gain of the antenna rings 62, 64, and 66 of FIG. 9 at an operational frequency of 0.6 GHz, according to an embodiment.

And FIG. 13 is a three-dimensional polar plot of the collective gain of the antenna rings 62, 64, and 66 of FIG. 9 at the operational frequency of 0.6 GHz, according to an embodiment.

Referring to FIGS. 9 and 12-13, when the second antenna ring 64 is operated at the frequency of 0.6 GHz (the first and third antenna rings 62 and 66 are inactive), the antenna rings' collective beam pattern has a relatively uniform gain at all azimuth angles, i.e., in all azimuth directions, at each elevation angle. For example, the plot in FIG. 12 shows that the antenna rings 62, 64, and 66 collectively have a gain of approximately 4 dBic in all azimuth directions at an elevation angle of 30° relative to an azimuth plane. Moreover, the plot of FIG. 13 shows that although the gains at elevation angles other than 30° may be different from the 4 dBic gain at an elevation angle of 30°, the gains at the other elevation angles are relatively uniform in all azimuth directions. Comparing the plots in FIGS. 12-13 to the plots in FIGS. 5-6, it is evident that at 0.6 GHz, the collective gain of the antenna rings 62, 64, and 66 is significantly more uniform than gain of the antenna ring 14 of FIG. 1.

FIG. 14 is a two-dimensional polar plot of the collective gain of the antenna rings 62, 64, and 66 of FIG. 9 at an operational frequency of 1.2 GHz, according to an embodiment.

And FIG. 15 is a three-dimensional polar plot of the collective gain of the antenna rings 62, 64, and 66 of FIG. 9 at the operational frequency of 1.2 GHz, according to an embodiment.

Referring to FIGS. 9 and 14-15, when the third antenna ring 66 is operated at the frequency of 1.2 GHz (the first and second antenna rings 62 and 64 are inactive), the antenna rings' collective gain is relatively uniform at all azimuth angles, i.e., in all azimuth directions, at each elevation angle. For example, the plot in FIG. 14 shows that the antenna rings 62, 64, and 66 collectively have a gain of approximately 4 dBic in all azimuth directions at an elevation angle of 30° relative to an azimuth plane. Moreover, the plot of FIG. 15 shows that although the gains at elevation angles other than 30° may be different from the 4 dBic gain at an elevation angle of 30°, the gains at the other elevation angles are relatively uniform in all azimuth directions. Comparing the plots in FIGS. 14-15 to the plots in FIGS. 7-9, it is evident that at 1.2 GHz, the gain of the antenna rings 62, 64, and 66 is significantly more uniform than gain of the antenna ring 14 of FIG. 1.

Referring to FIGS. 9-15, there are a number of techniques for exciting the dipoles of the antenna rings 62, 64, and 66 when the wavelength Xs of an exciting signal is between $\lambda_1$ and $\lambda_2$, between $\lambda_2$ and $\lambda_3$, or greater than $\lambda_3$. For example, if $\lambda_s<\lambda_1$ or $\lambda_1<\lambda_s<\lambda_2$, then the transmit/receive circuitry (not shown in FIGS. 9-15) can activate only the antenna ring 62. Similarly, if $\lambda_2<\lambda_s<\lambda_3$, then the transmit/receive circuitry can activate only the second antenna ring 64, and if $\lambda_s>\lambda_3$, then the transmit/receive circuitry can activate only the third antenna ring 66. Or, if $\lambda_s<\lambda_1$, then the transmit/receive circuitry can activate only the first antenna ring 62, and if $\lambda_1<\lambda_s<\lambda_2$, then the transmit/receive circuitry can activate only the second antenna ring 64. Similarly, if $\lambda_2<\lambda_s<\lambda_3$ of if $\lambda_s>\lambda_3$, then the transmit/receive circuitry can activate only the third antenna ring 66. Alternatively, the transmit/receive circuitry can apportion signal power to more than one of the antenna rings 62, 64, and 66. For example, if $\lambda_s<\lambda_1$, then the transmit/receive circuitry can activate, and apportion transmit/receive signal power to, only the first antenna ring 62. But if $\lambda_1<\lambda_s<\lambda_2$, then the transmit/receive circuitry can activate the first and second antenna ring 62 and 64, and apportion transmit/receive signal power as follows: $\lambda_1-\lambda_s/\lambda_1-\lambda_2\%$ of the transmit/receive signal power to the second antenna ring, and $1-\lambda_1-\lambda_s/\lambda_1-\lambda_2\%$ of the transmit/receive signal power to the first antenna ring. Similarly, if $\lambda_2<\lambda_s<\lambda_3$, then the transmit/receive circuitry can activate the second and third antenna rings 64 and 66, and apportion transmit/receive signal power as follows:

$$\frac{\lambda_2-\lambda_s}{\lambda_2-\lambda_3}\%$$

of the transmit/receive signal power to the third antenna ring, and $$1-\frac{\lambda_2-\lambda_s}{\lambda_2-\lambda_3}\%$$

of the transmit/receive power to the second antenna ring. And if $\lambda_s>\lambda_3$, then the transmit/receive circuitry can activate, and provide transmit/receive signal power to, only the third antenna ring 66.

Referring again to FIG. 9, alternate embodiments of the antenna array 60 are contemplated. For example, although the array 60 is described as including three antenna rings 62, 64, and 66, the array can include two, or more than three, antenna rings. Furthermore, although the tuned frequencies of the antenna rings 62, 64, and 66 are described as the lowest frequency of the frequency range for which the antenna array 60 is designed, and frequencies equal to the product of the lowest frequency and powers of 2 (i.e., lowest frequency$\times 2^0$, lowest frequency$\times 2^1$, lowest frequency$\times 2^2$, . . . , lowest frequency$\times 2^n$), the tuned frequencies may be selected according to a different methodology. Moreover, although the antenna rings 62, 64, and 66 are described as having their corresponding sides approximately parallel and perpendicular to one another, one or more of the antenna rings may be rotated about the center 72 relative to one or more of the other antenna rings such that corresponding sides of at least two of the rings are not approximately parallel or perpendicular to one another. In addition, the antenna rings 62, 64, and 66 may not all be concentric with one another, and may not all be coplanar with one another. Furthermore, although the antennas 68, 70, 78, 80, 88, and 90 are described as being center-fed half-wave dipole antennas, these antennas can be any type of antenna (e.g., quarter-wave dipole, subwavelength dipole where the length of the dipole is much, much less than then wavelength at which the dipole is operated), and some of these antennas can be of different types than others of these antennas. Moreover, although described as being designed for a frequency range of 0.3 GHz-2.8 GHz, the antenna rings 62, 64, and 66, and the remainder of the antenna array 60, can be designed for other frequency ranges, such as 0.7 GHz-2.8 GHz. In addition, transmit/receive signal power can be apportioned to more than one antenna ring according to a formula/algorithm other than the power-apportionment formula/algorithm described above. Furthermore, other structural and operational features that can be used in alternate embodiments of the antenna array 60 are described in U.S. Patent Publication No. 2015/0357720, entitled MULTIPLE-INPUT MULTIPLE-OUTPUT ULTRA-WIDEBAND ANTENNAS, filed 13 Jan. 2014, published 10 Dec. 2015, which patent application was incorporated by reference above. For example, the antenna array 60 may be partially or fully covered by a conventional radome.

FIG. 16 is a block diagram of a communication unit 100, which includes one or more of the antenna arrays 60 of FIG. 9, according to an embodiment.

In addition to the one or more antenna arrays $\mathbf{60}_1$-$\mathbf{60}_m$, the communication unit 100 includes communication circuitry 102, an input/output (1/O) port 104, and an antenna port 106 for coupling to the antenna array(s).

The communication unit 100 can be a base station, remote unit, or other type of transmitter, receiver, or transmitter/receiver. If the communication unit 100 is a transmitter, then the communication circuitry 102 includes a transmitter circuit 108, which can be conventional; if the communication unit is a receiver, then the communication circuitry includes a receiver circuit 110, which also can be conventional; and if the communication unit is a transmitter/receiver, then the communication circuitry includes both the transmitter circuit and the receiver circuit.

Still referring to FIG. 16, operation of the communication unit 100 is described in an embodiment where the unit is a MIMO-OFDM transmitter/receiver, it being understood that if the communication unit is a transmitter, then its operation can be similar to that described below for transmitting mode, and that if the communication unit is a receiver, then its operation can be similar to that described below for receiving mode.

During a transmitting mode, the transmitter circuit 108 receives, via the I/O port 104, data for transmitting to a remote source (not shown in FIG. 16) via the one or more antenna arrays 60.

The transmitter circuit 108 parses the received data into one or more data or information symbols, one symbol for each antenna in the one or more antenna arrays 60. For example, if the communication unit 100 includes one antenna array $\mathbf{60}_1$, then the transmitter circuit 108 generates a first information symbol for transmission via the conical monopole antenna 94 (FIG. 9) of the antenna array $\mathbf{60}_1$, and generates a second information symbol for transmission via the antenna formed by the combination of antenna rings 62, 64, and 66 (FIG. 9) of the antenna array $\mathbf{60}_1$.

Next, the transmitter 108 modulates each of multiple carrier signals (one carrier signal per each antenna of the one or more antenna arrays $\mathbf{60}_1$) with a respective one of the information symbols, and drives each antenna with a respective one of the modulated carrier signals. For example, if the communication unit 100 includes one antenna array $\mathbf{60}_1$, then the transmitter circuit 108 drives the conical monopole antenna 94 (FIG. 9) of the antenna array $\mathbf{60}_1$ with a first symbol-modulated carrier signal, and drives one or more of the antenna rings 62, 64, and 66 (FIG. 9) of the antenna array $\mathbf{60}_1$ with a second symbol-modulated carrier signal (the transmitter circuit can apportion signal power of the second symbol-modulated carrier signal among the antenna rings as described above in conjunction with FIGS. 9-15). Furthermore, the isolation between the monopole antenna 94 and antenna rings 62, 64, and 66, and the different signal polarizations provided by the monopole antenna and the antenna rings (this isolation and these different signal polarizations are described above in conjunction with FIG. 9), diversify the respective channel between the antennas of each of the one or more antenna arrays 60 and the antenna(s) of the remote receiver (not shown in FIG. 16). As is known, such channel diversification can facilitate the remote receiver's recovery of the symbols from the symbol-modulated carrier signals.

During a receiving mode, the receiver circuit 110 receives, via the antenna I/O port 106, signals received from a remote source (not shown in FIG. 16) via the one or more antenna arrays 60. The receiver circuit 110 receives one signal per antenna. For example, if the communication unit 100 includes one antenna array $\mathbf{60}_1$, then the receiver circuit 110 receives a first signal from the monopole antenna 94 (FIG. 9), and receives a second signal from the antenna rings 62, 64, and 66 (the receiver circuit can apportion signal power of the received second signal among the antenna rings as described above in conjunction with FIGS. 9-15).

The receiver circuit 110 then demodulates the received signals, and recovers from the demodulated signals the symbols transmitted by the remote source (not shown in FIG. 16). As described above, the isolation between the monopole antenna 94 and antenna rings 62, 64, and 66, and the different signal polarizations provided by the monopole antenna and the antenna rings (this isolation and these different signal polarizations are described above in conjunction with FIG. 9), diversify the respective channel between each of the antennas of the one or more antenna arrays 60 and the antenna(s) of the remote transmitter (not shown in FIG. 16). As is known, such channel diversification can facilitate the recovery of the symbols from the demodulated signals by the receiving circuit 110.

Next, the receiver circuit 110 recovers the data/information from the recovered symbols, and provides the recovered data to a data recipient (not shown in FIG. 16) via the I/O port 104.

Referring to FIGS. 9 and 16, alternate embodiments of the communication unit 100 are contemplated. For example, although described as simultaneously using both the monopole antenna 94 and antenna rings 62, 64, and 66 of the one or more antenna arrays 60 either for transmitting or receiving, the communication unit 100 can simultaneously use the monopole antenna for transmitting and the antenna rings for receiving, or vice-versa. Furthermore, the communication unit 100 can operate according to a technique other than MIMO-OFDM.

FIG. 17 is a block diagram of a distributed antenna system (DAS) 120, which can include one or more of the communication units 100 of FIG. 16, according to an embodiment. In the described example, at least one of the remote units 124 of the DAS 120 is, or includes, at least one communication unit 100 of FIG. 16.

The DAS 120 includes one or more master units 122 and one or more remote units 124 that are communicatively coupled to the master units 122. Further in this embodiment, the DAS 120 comprises a digital DAS, in which DAS traffic is distributed between the master units 122 and the remote units 124 in digital form. In other embodiments, the DAS 120 is implemented, at least in part, as an analog DAS, in which DAS traffic is distributed at least part of the way between the master units 122 and the remote units 124 in analog form.

Each master unit 122 is communicatively coupled to one or more base stations 126. One or more of the base stations 126 can be co-located with the respective master unit 122 to which it is coupled (for example, where the base station 126 is dedicated to providing base station capacity to the DAS 120). Also, one or more of the base stations 126 can be located remotely from the respective master unit 122 to which it is coupled (for example, where the base station 126 is a macro base station providing base station capacity to a macro cell in addition to providing capacity to the DAS 120). In this latter case, a master unit 122 can be coupled to a donor antenna in order to wirelessly communicate with the remotely located base station 126.

The base stations 126 can be implemented as traditional monolithic base stations. Also, the base stations 126 can be implemented using a distributed base station architecture in which a base band unit (BBU) is coupled to one or more remote radio heads (RRHs), where the front haul between the BBU and the RRH uses streams of digital IQ samples. Examples of such an approach are described in the Common Public Radio Interface (CPRI) and Open Base Station Architecture Initiative (OBSAI) families of specifications.

The master units 122 can be configured to use wideband interfaces or narrowband interfaces to the base stations 126. Also, the master units 122 can be configured to interface with the base stations 126 using analog radio frequency (RF) interfaces or digital interfaces (for example, using a CPRI or OBSAI digital IQ interface).

Traditionally, each master unit 122 interfaces with each base station 126 using the analog radio frequency signals that each base station 126 communicates to and from mobile units 128 using a suitable air interface standard. The DAS 120 operates as a distributed repeater for such radio frequency signals. RF signals transmitted from each base station 126 (also referred to herein as "downlink RF signals") are received at one or more master units 122. Each master unit 122 uses the downlink RF signals to generate a downlink transport signal that is distributed to one or more of the remote units 124. Each such remote unit 124 receives the downlink transport signal and reconstructs a version of the downlink RF signals based on the downlink transport signal and causes the reconstructed downlink RF signals to be radiated from at least one antenna array 60 coupled to or included in that remote unit 124.

A similar process is performed in the uplink direction. RF signals transmitted from mobile units 128 (also referred to herein as "uplink RF signals") are received at one or more remote units 124. Each remote unit 124 uses the uplink RF signals to generate an uplink transport signal that is transmitted from the remote unit 124 to a master unit 122. Each master unit 122 receives uplink transport signals transmitted from one or more remote units 124 coupled to it. The master unit 122 combines data or signals communicated via the uplink transport signals received at the master unit 122 and reconstructs a version of the uplink RF signals received at the remote units 124. The master unit 122 communicates the reconstructed uplink RF signals to one or more base stations 126. In this way, the coverage of the base stations 126 can be expanded using the DAS 120.

One or more intermediate units 130 (some of which are also referred to here as "expansion units" 130 can be placed between the master units 122 and one or more of the remote units 124. This can be done, for example, in order to increase the number of remote units 124 that a single master unit 122 can feed, to increase the master-unit-to-remote-unit distance, and/or to reduce the amount of cabling needed to couple a master unit 122 to its associated remote units 124.

As noted above, the DAS 120 is implemented as a digital DAS. In a "digital" DAS, signals received from and provided to the base stations 126 and mobile units 128 are used to produce digital in-phase (I) and quadrature (Q) samples, which are communicated between the master units 122 and remote units 124. It is important to note that this digital IQ representation of the original signals received from the base stations 126 and from the mobile units 128 still maintains the original modulation (that is, the change in the amplitude, phase, or frequency of a carrier) used to convey telephony or data information pursuant to the cellular air interface protocol used for wirelessly communicating between the base stations 126 and the mobile units 128. Examples of such cellular air interface protocols include, for example, the Global System for Mobile Communication (GSM), Universal Mobile Telecommunications System (UMTS), High-Speed Downlink Packet Access (HSDPA), and Long-Term Evolution (LTE) air interface protocols. Also, each stream of digital IQ samples represents or includes a portion of wireless spectrum. For example, the digital IQ samples can represent a single radio access network carrier (for example, a UMTS or LTE carrier of 5 MHz) onto which voice or data information has been modulated using a UMTS or LTE air interface. However, it is to be understood that each such stream can also represent multiple carriers (for example, in a band of frequency spectrum or a sub-band of a given band of frequency spectrum).

Furthermore, one or more of the master units 122 are configured to interface with one or more base stations 126 using an analog RF interface (for example, either a traditional monolithic base station 126 or via the analog RF interface of an RRH). The base stations 126 can be coupled to the master units 122 using a network of attenuators, combiners, splitters, amplifiers, filters, cross-connects, etc., (sometimes referred to collectively as a "point-of-interface" or "POI"). This is done so that, in the downstream, the desired set of RF carriers output by the base stations 126 can be extracted, combined, and routed to the appropriate master unit 122, and so that, in the upstream, the desired set of carriers output by the master unit 122 can be extracted, combined, and routed to the appropriate interface of each base station 126.

Each master unit 122 can produce digital IQ samples from an analog wireless signal received at radio frequency (RF) by down-converting the received signal to an intermediate frequency (IF) or to baseband, digitizing the down-converted signal to produce real digital samples, and digitally down-converting the real digital samples to produce digital in-phase (I) and quadrature (Q) samples. These digital IQ samples can also be filtered, amplified, attenuated, and/or re-sampled or decimated to a lower sample rate. The digital samples can be produced in other ways. Each stream of digital IQ samples represents a portion of wireless radio frequency spectrum output by one or more base stations 126. Each portion of wireless radio frequency spectrum can include, for example, a band of wireless spectrum, a sub-band of a given band of wireless spectrum, or an individual wireless carrier.

Likewise, in the upstream, each master unit 122 can produce an upstream analog wireless signal from one or more streams of digital IQ samples received from one or more remote units 124 by digitally combining streams of digital IQ samples that represent the same carriers or frequency bands or sub-bands (for example, by digitally summing such digital IQ samples), digitally up-converting the combined digital IQ samples to produce real digital samples, performing a digital-to-analog process on the real samples in order to produce an IF or baseband analog signal, and up-converting the IF or baseband analog signal to the desired RF frequency. The digital IQ samples can also be filtered, amplified, attenuated, and/or re-sampled or interpolated to a higher sample rate, before and/or after being combined. The analog signal can be produced in other ways (for example, where the digital IQ samples are provided to a quadrature digital-to-analog converter that directly produces the analog IF or baseband signal).

One or more of the master units 122 can be configured to interface with one or more base stations 126 using a digital interface (in addition to, or instead of) interfacing with one or more base stations 126 via an analog RF interface. For example, the master unit 122 can be configured to interact directly with one or more BBUs using the digital IQ interface that is used for communicating between the BBUs and an RRHs (for example, using the CPRI serial digital IQ interface).

In the downstream, each master unit 122 terminates one or more downstream streams of digital IQ samples provided to it from one or more BBUs and, if necessary, converts (by re-sampling, synchronizing, combining, separating, gain adjusting, etc.) them into downstream streams of digital IQ samples compatible with the remote units 124 used in the DAS 120. In the upstream, each master unit 122 receives upstream streams of digital IQ samples from one or more remote units 124, digitally combining streams of digital IQ samples that represent the same carriers or frequency bands or sub-bands (for example, by digitally summing such digital IQ samples), and, if necessary, converts (by re-sampling, synchronizing, combining, separating, gain adjusting, etc.) them into upstream streams of digital IQ samples compatible with the one or more BBUs that are coupled to that master unit 122.

Each master unit 122 can be implemented in other ways.

In the downstream, each remote unit 124 receives streams of digital IQ samples from one or more master units 122, where each stream of digital IQ samples represents a portion of wireless radio frequency spectrum output by one or more base stations 126.

Each remote unit 124 is communicatively coupled to one or more master units 122 using one or more ETHERNET-compatible cables 132 (for example, one or more CAT-6A cables). In this embodiment, each remote unit 124 can be directly connected to a master unit 122 via a single ETHERNET cable 132 or indirectly via multiple ETHERNET-compatible cables 132 such as where a first ETHERNET cable 132 connects the remote unit 124 to a patch panel or expansion unit 130 and a second optical fiber cable 132 connects the patch panel or expansion unit 130 to the master unit 122. Each remote unit 124 can be coupled to one or more master units 122 in other ways.

The methods and techniques described herein may be implemented in analog electronic circuitry, digital electronic circuitry, or with a programmable processor (for example, a special-purpose processor, a general-purpose processor such as a computer, a microprocessor, or microcontroller) firmware, software, or in combinations of them. Apparatuses embodying these techniques may include appropriate input and output devices, a programmable processor, and a storage medium tangibly embodying program instructions for execution by the programmable processor. A process embodying these techniques may be performed by a programmable processor executing a program of instructions to perform desired functions by operating on input data and generating appropriate output. The techniques may advantageously be implemented in one or more programs that are executable on a programmable system including at least one programmable processor coupled to receive data and instructions from, and to transmit data and instructions to, a data storage system, at least one input device, and at least one output device.

Generally, a processor will receive instructions and data from a read-only memory and/or a random access memory. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and DVD disks. Any of the foregoing may be supplemented by, or incorporated in, specially-designed application-specific integrated circuits (ASICs).

A number of embodiments of the invention defined by the following claims have been described. Nevertheless, it will be understood that various modifications to the described embodiments may be made without departing from the spirit and scope of the claimed invention. Accordingly, other embodiments are within the scope of the following claims.

The invention claimed is:

1. An antenna array, comprising: a first antenna ring of first dipole antennas each spaced approximately a first distance from a center of the first antenna ring and each having a length that is approximately twice the first distance; and a second antenna ring of second dipole antennas each spaced approximately a second distance from the center and each having a length that is approximately twice the second distance, the second antenna ring approximately concentric and coplanar with the first antenna ring, and each of at least one of the second dipole antennas approximately parallel to a respective one of the first dipole antennas, there being no antenna ring between the first and the second antenna rings.

2. The antenna array of claim 1 where the first and second antenna rings each have an approximately square shape.

3. The antenna array of claim 1 wherein the second distance is approximately twice the first distance.

4. The antenna array of claim 1, further comprising a third antenna that is approximately perpendicular to, and approximately centered within, the first and second antenna rings.

5. The antenna array of claim 1, further comprising a conductive plane separated from, and approximately parallel to, the first and second antenna rings.

6. An antenna array, comprising: a first pair of antennas spaced apart from each other by a first distance; a second pair of antennas located between the first pair of antennas, spaced apart from each other by the first distance, being approximately equidistant from a midpoint between the first pair of antennas, and being approximately coplanar with the first pair of antennas; a third pair of antennas spaced apart from each other by a second distance, being equidistant from the midpoint, being approximately coplanar with the first and second pairs of antennas, and each being adjacent, and approximately parallel, to a respective one of the antennas of the first pair; and a fourth pair of antennas located between the third pair of antennas, spaced apart from each other by approximately the second distance, being approximately equidistant from the midpoint, being approximately coplanar with the first, second, and third pairs of antennas, and each being adjacent, and approximately parallel, to a respective one of the antennas of the second pair.

7. The antenna array of claim 6 wherein the antennas of the first, second, third, and fourth pairs each comprise a respective half-wavelength dipole antenna.

8. The antenna array of claim 6 wherein:

the antennas of the first, second, third, and fourth pairs each comprise a respective dipole antenna;

the antennas of the first pair are approximately parallel to one another;

the antennas of the second pair are approximately parallel to one another;

the antennas of the third pair are approximately parallel to one another; and the antennas of the fourth pair are approximately parallel to one another.

9. The antenna array of claim 6 wherein:

the antennas of the first, second, third, and fourth pairs each comprise a respective dipole antenna;

the antennas of the first pair are approximately parallel to one another;

the antennas of the second pair are approximately parallel to one another and approximately orthogonal to the antennas of the first pair;

the antennas of the third pair are approximately parallel to one another and to the antennas of the first pair, and are approximately orthogonal to the antennas of the second pair; and the antennas of the fourth pair are approximately parallel to one another and to the antennas of the second pair, and are approximately orthogonal to the antennas of the first and third pairs.

10. The antenna array of claim 6 wherein:

the antennas of the first and second pairs are tuned to transmit or to receive a signal having a wavelength that is approximately twice the first distance; and the antennas of the third and fourth pairs are tuned to transmit or to receive a signal having a wavelength that is approximately twice the second distance.

11. The antenna array of claim 6 wherein:

the antennas of the first and second pairs are tuned to transmit or to receive a signal having a wavelength that is approximately twice the first distance;

the antennas of the third and fourth pairs are tuned to transmit or to receive a signal having a wavelength that is approximately twice the second distance; and the second distance is approximately twice the first distance.

12. The antenna array of claim 6, further comprising an antenna that is approximately orthogonal to the antennas in the first, second, third, and fourth pairs of antennas and that is approximately centered about the midpoint.

13. The antenna array of claim 6, further comprising a conical antenna having an axis that is approximately orthogonal to the antennas in the first, second, third and fourth pairs of antennas and that intersects the midpoint.

14. The antenna array of claim 6, further comprising a conductive surface that is spaced apart from, and that is approximately parallel to, the antennas of the first, second, third, and fourth pairs.

15. The antenna array of claim 6, further comprising:

a first feed circuit coupled to the antennas of the first and second pairs; and a second feed circuit coupled to the antennas of the third and fourth pairs.

16. The antenna array of claim 6, further comprising: a fifth pair of antennas spaced apart from each other by a third distance, being approximately equidistant from the midpoint, and being approximately coplanar with the first, second, third, and fourth pairs of antennas; and a sixth pair of antennas located between the fifth pair of antennas, spaced apart from each other by approximately the third distance, being approximately equidistant from the midpoint, and being approximately coplanar with the first, second, third, fourth, and fifth pairs of antennas.

17. A transmitter, comprising: an antenna array, comprising a first pair of antennas spaced apart from each other by a first distance; a second pair of antennas located between the first pair of antennas, spaced apart from each other by approximately the first distance, being approximately equidistant from a midpoint between the first pair of antennas, and being approximately coplanar with the first pair of antennas; a third pair of antennas spaced apart from each other by a second distance, being approximately equidistant from the midpoint, being approximately coplanar with the first and second pairs of antennas, and each being adjacent, and approximately parallel, to a respective one of the antennas of one of the first and second pairs; a fourth pair of antennas located between the third pair of antennas, spaced apart from each other by approximately the second distance, being approximately equidistant from the midpoint, being approximately coplanar with the first, second, and third pairs of antennas, and each being adjacent, and approximately parallel, to a respective one of the antennas of the other of the first and second pairs; and a transmitter circuit configured to drive the antennas of the first and second pairs with a first signal having a wavelength that is approximately twice the first distance such that the antennas of the first pair are approximately 180° out of phase with one another and the antennas of the second pair are approximately 180° out of phase with one another; and to drive the antennas of the third and fourth pairs with a second signal having a wavelength that is approximately twice the second distance such that the antennas of the third pair are approximately 180° out of phase with one another and the antennas of the fourth pair are approximately 180° out of phase with one another.

18. A receiver, comprising: an antenna array, comprising a first pair of antennas spaced apart from each other by a first distance; a second pair of antennas located between the first pair of antennas, spaced apart from each other by approximately the first distance, being approximately equidistant from a midpoint located between the first pair of antennas, and being approximately coplanar with the first pair of antennas; a third pair of antennas spaced apart from each other by a second distance, being approximately equidistant from the midpoint, being approximately coplanar with the first and second pairs of antennas, and each being adjacent, and approximately parallel, to a respective one of the antennas of one of the first and second pairs; a fourth pair of antennas located between the third pair of antennas, spaced apart from each other by approximately the second distance, being approximately equidistant from the midpoint, and being approximately coplanar with the first, second, and third pairs of antennas, and each being adjacent, and approximately parallel, to a respective one of the antennas of the other of the first and second pairs; and a receiver circuit configured to receive from the antennas of the first and second pairs a first signal having a wavelength that is approximately twice the first distance such that there is a phase difference of approximately 180° between the antennas of the first pair and a phase difference of approximately 180° between the antennas of the second pair; and to receive from the antennas of the third and fourth pairs a second signal having a wavelength that is approximately twice the second distance such that there is a phase difference of approximately 180° between the antennas of the third pair and a phase difference of approximately 180° between the antennas of the fourth pair.

19. A distributed antenna system, comprising: a base unit; and a remote unit coupled to the base unit and comprising: an antenna array, comprising a first pair of antennas spaced apart from each other by a first distance; a second pair of antennas located between the first pair of antennas, spaced apart from each other by approximately the first distance, being approximately equidistant from a midpoint between the first pair of antennas, and being approximately coplanar with the first pair of antennas; a third pair of antennas spaced apart from each other by a second distance, being approximately equidistant from the midpoint, being approximately coplanar with the first and second pairs of antennas, and each being adjacent, and approximately parallel, to a respective one of the antennas of the second pair; a fourth pair of antennas located between the third pair of antennas, spaced apart from each other by approximately the second distance, being approximately equidistant from the midpoint, being approximately coplanar with the first, second, and third pairs of antennas, and each being adjacent, and approximately parallel, to a respective one of the antennas of the first pair; a transmitter circuit configured to receive, from the base unit, first data; to generate, in response to the first data, a first signal having a wavelength that is approximately twice the first distance and a second signal having a wavelength that is approximately twice the second distance; to drive the antennas of the first and second pairs with the first signal such that the antennas of the first pair are approximately 180° out of phase with one another and the antennas of the second pair are approximately 180° out of phase with one another; and to drive the antennas of the third and fourth pairs with the second signal such that the antennas of the third pair are approximately 180° out of phase with one another and the antennas of the fourth pair are approximately 180° out of phase with one another; and a receiver circuit configured to receive from the antennas of the first and second pairs a third signal having a wavelength that is approximately twice the first distance such that there is a phase difference of approximately 180° between the antennas of the first pair and a phase difference of approximately 180° between the antennas of the second pair; to receive from the antennas of the third and fourth pairs a fourth signal having a wavelength that is approximately twice the second distance such that there is a phase difference of approximately 180° between the antennas of the third pair and a phase difference of approximately 180° between the antennas of the fourth pair; to recover second data from the first and second signals; and to provide the second data to the base unit.

20. A method, comprising:

transmitting a signal having a wavelength from first antennas each forming a respective portion of a perimeter of a first approximately square antenna ring, each of the first antennas being shorter than one half of the wavelength; and transmitting the signal from second antennas each forming a respective portion of a perimeter of a second approximately square antenna ring, each of the second antennas being longer than one half of the wavelength, the second antenna ring being approximately concentric and coplanar with the first antenna ring.

21. The method of claim 20, further comprising:

the first antenna ring including pairs of the first antennas, the first antennas of each pair intersecting a respective line that passes through a center of the first and second antenna rings and being on opposite sides of the center; and the second antenna ring including pairs of the second antennas, the second antennas of each pair intersecting a respective one of the lines and being on opposite sides of the center.

22. The method of claim 20 wherein transmitting the signal from the first and second antennas includes transmitting the signal such that energy from the signal is approximately zero at a center of the first and second antenna rings.

23. The method of claim 20 wherein transmitting the signal from the first and second antennas includes transmitting the signal such that the signal is elliptically or circularly polarized.

24. The method of claim 20 wherein:

transmitting the signal with the first antennas includes transmitting the signal with a first power; and transmitting the signal with the second antennas includes transmitting the signal with a second power.

25. The method of claim 24 wherein the first and second powers are different.

26. The method of claim 24 wherein the first and second powers are equal.

27. A method, comprising: receiving a signal having a wavelength from first antennas each forming a respective portion of a perimeter of a first approximately square antenna ring, each of the first antennas being shorter than one half of the wavelength; and receiving the signal from second antennas each forming a respective portion of a perimeter of a second approximately square antenna ring, each of the second antennas being longer than one half of the wavelength, the second antenna ring being approximately concentric and coplanar with the first antenna ring.

28. The method of claim 27 wherein:

receiving the signal from the first antennas comprises receiving the signal from the first antennas with a first gain; and receiving the signal from the second antennas comprises receiving the signal from the second antennas with a second gain.

* * * * *